US011737614B2

(12) United States Patent
Mainville et al.

(10) Patent No.: US 11,737,614 B2
(45) **Date of Patent: *Aug. 29, 2023**

(54) WEB MATERIAL DISPENSER AND METHOD

(71) Applicant: CASCADES CANADA ULC, Kingsey Falls (CA)

(72) Inventors: Patrick Mainville, Montréal (CA); Mélody Sue Myette, Montréal (CA); Benoit Orban, Saint-Lambert (CA)

(73) Assignee: CASCADES CANADA ULC, Kingsey Falls (CA)

( * ) Notice: Subject to any disclaimer, the term of this patent is extended or adjusted under 35 U.S.C. 154(b) by 0 days.

This patent is subject to a terminal disclaimer.

(21) Appl. No.: 17/682,912

(22) Filed: Feb. 28, 2022

(65) Prior Publication Data

US 2022/0177247 A1 Jun. 9, 2022

Related U.S. Application Data

(63) Continuation of application No. 16/294,612, filed on Mar. 6, 2019, now Pat. No. 11,299,361.

(60) Provisional application No. 62/749,710, filed on Oct. 24, 2018, provisional application No. 62/640,626, (Continued)

(51) Int. Cl.

| | |
|---|---|
| ***A47K 10/36*** | (2006.01) |
| ***B65H 16/04*** | (2006.01) |
| ***B65H 16/02*** | (2006.01) |
| ***B65H 18/28*** | (2006.01) |
| ***A47K 10/32*** | (2006.01) |

(52) U.S. Cl.
CPC ..... *A47K 10/3687* (2013.01); *B65H 16/023* (2013.01); *B65H 16/04* (2013.01); *A47K 2010/3253* (2013.01); *B65H 18/28* (2013.01)

(58) Field of Classification Search
None
See application file for complete search history.

(56) References Cited

U.S. PATENT DOCUMENTS

| | | | |
|---|---|---|---|
| 4,422,585 | A | 12/1983 | Schultz et al. |
| 4,872,601 | A | 10/1989 | Sigmund |
| 5,310,129 | A | 5/1994 | Whittington et al. |

(Continued)

FOREIGN PATENT DOCUMENTS

| | | | |
|---|---|---|---|
| DE | 2103842 | A1 | 10/1971 |
| WO | WO-2018/127618 | A1 | 7/2018 |

*Primary Examiner* — William A. Rivera
(74) *Attorney, Agent, or Firm* — Marshall, Gerstein & Borun LLP

(57) ABSTRACT

A web material dispenser includes a housing and a pivotable roll support assembly provided therein. A first mandrel is provided at a first attachment location of the roll support assembly to support a first roll of web material. A second mandrel is provided at a second location of the roll support assembly to support a second roll of web material. The web material dispenser permits one-handed operation to replace the rolls of web material and to change positions of the mandrels within the dispenser. The roll support assembly may have a linkage arm and/or a roll support arm. Positions of the first and second mandrels relative to the dispenser's opening can be switched by pivoting the linkage arm relative to the housing and by pivoting the roll support arm relative to the linkage arm. A method for switching positions of rolls in the web material dispenser is also provided.

16 Claims, 20 Drawing Sheets

Related U.S. Application Data filed on Mar. 9, 2018, provisional application No. 62/640,936, filed on Mar. 9, 2018.

(56) References Cited

U.S. PATENT DOCUMENTS

| | | | |
|---|---|---|---|
| 5,628,474 | A | 5/1997 | Krueger et al. |
| 5,690,299 | A | 11/1997 | Perrin et al. |
| 6,378,800 | B1 | 4/2002 | Apichom |
| 6,752,349 | B2 | 6/2004 | Moody et al. |
| 6,793,170 | B2 | 9/2004 | Denen et al. |
| 7,182,288 | B2 | 2/2007 | Denen et al. |
| 7,431,236 | B2 | 10/2008 | Larsson |
| 7,878,444 | B2 | 2/2011 | Friesen et al. |
| 7,913,945 | B2 | 3/2011 | Friesen et al. |
| 8,096,495 | B2 | 1/2012 | Billman |
| 8,511,600 | B2 | 8/2013 | Formon et al. |
| 9,066,638 | B2 | 6/2015 | Lowery et al. |
| 9,138,110 | B2 | 9/2015 | Knight et al. |
| 9,241,601 | B2 | 1/2016 | Case et al. |
| 9,770,142 | B2 | 9/2017 | Ochoa, Sr. et al. |
| 10,952,569 | B2 | 3/2021 | Grosz, Jr. et al. |
| 11,299,361 | B2 * | 4/2022 | Mainville ..... B65H 16/023 |
| 2006/0102770 | A1 | 5/2006 | Goeking et al. |
| 2006/0236836 | A1 | 10/2006 | Cassia |
| 2008/0078855 | A1 | 4/2008 | Forman et al. |
| 2009/0266928 | A1 | 10/2009 | Friesen et al. |
| 2009/0266929 | A1 | 10/2009 | Friesen et al. |
| 2016/0174779 | A1 | 6/2016 | Yaros |
| 2018/0177348 | A1 | 6/2018 | Swanson et al. |
| 2018/0194582 | A1 | 7/2018 | Rozek et al. |
| 2018/0368626 | A1 | 12/2018 | Williams, Jr. et al. |
| 2019/0274491 | A1 | 9/2019 | Mainville et al. |

* cited by examiner

WEB MATERIAL DISPENSER AND METHOD

RELATED PATENT APPLICATION

The present application is a continuation of U.S. patent application Ser. No. 16/294,612, filed on Mar. 6, 2019, which claims the benefit of the filing date of U.S. provisional patent application No. 62/640,936, filed Mar. 9, 2018 and entitled "WEB MATERIAL DISPENSER", U.S. provisional patent application No. 62/640,626, filed on Mar. 9, 2018, and entitled "BUSHING FOR A WEB MATERIAL ROLL, WEB MATERIAL ROLL AND RETENTION ASSEMBLY", and U.S. provisional patent application No. 62/749,710, filed on Oct. 24, 2018, and entitled "BUSHING FOR A WEB MATERIAL ROLL, WEB MATERIAL ROLL AND RETENTION ASSEMBLY". The disclosures of these U.S. patent applications are hereby incorporated by reference in their entireties.

TECHNICAL FIELD

The present disclosure generally relates to a web material dispenser and method and more particularly to a web material dispenser having a pivotally attached roll support assembly that can permit a single-handed change of a roll of web material and switching of the position of the rolls.

BACKGROUND

Various dispensers for dispensing a web material, such as toilet paper, from a roll, are known in the art. Web material dispensers can operate in different ways to permit changing one or more rolls of web material.

SUMMARY

According to one aspect, there is provided a web material dispenser having housing and a roll support assembly provided in the housing. The housing houses first and a second rolls of web material and has an opening for dispensing the web material. The roll support assembly includes a linkage arm provided with first and second attachment locations. The linkage arm is pivotally attached to the housing at the first attachment location. The roll support assembly also includes a roll support arm having first and second ends, the roll support arm being pivotally attached to the linkage arm at the second attachment location of the linkage arm. A first mandrel is provided at the first end of the roll support arm for supporting the first roll of web material and a second mandrel is provided at the second end of the roll support arm for supporting the second roll of web material. Positions of the first and second mandrels relative to the opening can be switched by pivoting the linkage arm relative to the housing and by pivoting the roll support arm relative to the linkage arm.

According to another aspect, there is provided a web material dispenser having a housing, a roll support assembly, a first mandrel and a second mandrel. The housing includes a back-wall member and a cover member having an opening, the cover member further being movable between a closed position and an open position. The roll support assembly is coupled to the housing and has a roll support arm being pivotally attached within the roll support assembly. The roll support arm has a first end and a second end, opposite the first end, the support arm being pivotable between at least one support arm roll changing position and at least one support arm dispensing position. The first mandrel extends from the first end of the roll support arm, to support a first roll of web material. The first mandrel as an extending end which is open end. The second mandrel extends from the second end of the roll support arm, to support a second roll of web material. The second mandrel also has an extending end which is an open or free end. In the open position of the cover member, positions of the first and second rolls of web material relative to the opening can be switched, to change one or more of the rolls of web material supported on the mandrels.

According to yet another aspect, there is provided a method of switching positions of rolls in a web material dispenser. The web material dispenser has a housing for housing first and second rolls of web material. The method includes providing a roll support assembly pivotally attached to the housing, the roll support assembly comprising a roll support arm having first and second ends, a first mandrel provided at the first end of the roll support arm and supporting a first roll of web material, and a second mandrel provided at the second end of the roll support arm for supporting the second roll of web material. The method further includes pivoting the roll support assembly away from a back-wall member of the housing, to provide clearance for the roll support arm to pivot. The roll support arm can be rotated about a pivot axis thereof, to move the first roll of web material, which is can be a full or non-depleted roll, to take the place of the second roll of web material, which is depleted. A new roll of web material can be provided onto the second mandrel. The roll support assembly can then be pivoted toward the back-wall member, back to a roll support dispensing position.

According to exemplary web material dispensers described herein, the linkage arm is pivotally attached to the housing at a fixed location of the housing.

According to exemplary web material dispensers described herein, the first and second attachment locations of the linkage arm are spaced apart and remote from one another.

According to exemplary web material dispensers described herein, the linkage arm comprises a first end and a second end, opposed to the first end, the first attachment location being on the first end and the second attachment location being on the second end.

According to exemplary web material dispensers described herein, the linkage arm is movable between a linkage arm dispensing position corresponding to a first angular position about the first attachment location of the linkage arm and a linkage arm roll changing position corresponding to a second angular position about the first attachment location of the linkage arm.

According to exemplary web material dispensers described herein, the housing comprises a back-wall member defining a backing plane, the linkage arm extends forwardly from the backing plane, in the linkage arm dispensing position, the linkage arm forms a first angle with the backing plane, and in the linkage arm roll changing position, the linkage arm forms a second angle with the backing plane, the second angle being greater than the first angle.

According to exemplary web material dispensers described herein, the second attachment location of the linkage arm is a fixed location on the linkage arm.

According to exemplary web material dispensers described herein, the first attachment location of the linkage arm defines a pivot axis of the linkage arm, representing a first pivot axis, parallel to the backing plane, the linkage arm being rotatable about the first pivot axis relative to the housing and the second attachment location of the linkage arm defines a pivot axis of the roll support arm, representing a second pivot axis, the second pivot axis being parallel to the first pivot axis, the roll support arm being rotatable about the second pivot axis relative to the linkage arm.

According to exemplary web material dispensers described herein, when the dispenser is in use, the pivot axis of the linkage arm is located above the pivot axis of the roll support arm.

According to exemplary web material dispensers described herein, the pivot axis of the roll support arm is located between the first and second ends of the roll support arm.

According to exemplary web material dispensers described herein, the pivot axis of the roll support arm is located at about a midpoint between the first and second ends of the roll support arm.

According to exemplary web material dispensers described herein, the roll support arm is operable to pivot about the second attachment location of the linkage arm between at least one support arm roll changing position and at least one support arm dispensing position.

According to exemplary web material dispensers described herein, in the dispensing position of the roll support arm, one of the mandrels is located above the other of the mandrels and in the roll-changing position of the roll support arm, one of the mandrels is located forwardly of the other of the mandrels.

According to exemplary web material dispensers described herein, in the dispensing position, the roll support arm extends substantially vertically relative to the ground and in the roll-changing position, the roll support arm extends substantially horizontally relative to the ground.

According to exemplary web material dispensers described herein, the first and second mandrels are maintained at a fixed position relative to one another and relative to the housing when the roll support arm is in the support arm dispensing position for dispensing material.

According to exemplary web material dispensers described herein, in the dispensing position, the roll support arm is aligned with a lateral side of the housing.

According to exemplary web material dispensers described herein, the roll support assembly further comprises a retaining mechanism operable to retain the roll support arm in the at least one dispensing position thereof.

According to exemplary web material dispensers described herein, the retaining mechanism is further operable to retain the roll support arm in the at least one roll changing position thereof.

According to exemplary web material dispensers described herein, the first and second mandrels extend from the first end and from the second end of the roll support arm, respectively and the first and second mandrels comprising first and second extending ends, respectively, said first and second extending ends being open.

According to exemplary web material dispensers described herein, the housing comprises the back-wall member and a cover member having an opening, the cover member further being movable between a closed position and an open position, in the closed position, the first and second mandrels are partially enclosed within the housing, in the open position of the cover member, the linkage arm and the roll support arm can both be pivoted to replace the first or second rolls of web material when depleted and/or to switch positions of the first and second rolls of web material relative to the opening.

According to exemplary web material dispensers described herein, in the closed position and upon the first roll of web material being supported on the first mandrel and the second roll of web material being supported on the second mandrel, at least a portion of each of the first roll of web material and the second roll of web material is accessible through the opening of the cover member.

According to exemplary web material dispensers described herein, wherein the dispenser further comprises an interfacing member extending forwardly from the back-wall member, the linkage arm being pivotally attached to the interface member.

According to exemplary web material dispensers described herein, the interfacing member is coupled to one of a left side and a right side of the housing.

According to exemplary web material dispensers described herein, the interfacing member comprises an arcuate guiding mechanism operable to guide pivotal movement of the linkage arm relative to the housing.

According to exemplary web material dispensers described herein, the arcuate guiding mechanism of the interfacing member provides an arc-shaped path and wherein the linkage arm comprises a follower element operatively engaging the arcuate guiding mechanism along the arc-shaped path.

According to exemplary web material dispensers described herein, in the closed position of the cover member and upon the first roll of web material being supported on the first mandrel and the second roll of web material being supported on the second mandrel, at least a portion of each of the web material of the first and second rolls is accessible through the opening of the cover member.

According to exemplary web material dispensers described herein, in the dispensing position of the roll support arm, one of the first and second mandrels is located above the other one of the first and second mandrels and in the roll-changing position of the roll support arm, one of the first and second mandrels is located forwardly of the other of the mandrels, relative to the back-wall member.

According to exemplary web material dispensers described herein, when the dispenser is in use: in the dispensing position, the roll support arm extends substantially vertically relative to the ground and in the roll-changing position, the roll support arm extends substantially horizontally relative to the ground.

According to exemplary web material dispensers described herein, the roll support assembly further comprises a retaining mechanism operable to retain the roll support arm in the at least one dispensing position thereof.

According to exemplary methods for switching positions of rolls in a web material dispenser described herein, the second mandrel is initially in a primary dispensing position and the first mandrel is initially in a secondary dispensing position and subsequent to rotating the roll support arm, the second mandrel reaches the secondary dispensing position and the first mandrel reaches the primary dispensing position.

According to exemplary methods for switching positions of rolls in a web material dispenser described herein, subsequent to rotating the roll support arm, the new roll of web material supported on the second mandrel is in the secondary primary position and the first roll of web material, being non-depleted, supported on first mandrel is in the primary dispensing position.

According to exemplary methods for switching positions of rolls in a web material dispenser described herein, the primary dispensing position is located below the secondary dispensing position relative to the ground.

According to exemplary methods for switching positions of rolls in a web material dispenser described herein, the method further includes rotating the roll support arm to a roll-changing position thereof, whereby the second mandrel is located forwardly of the first mandrel relative to the back-wall member and the roll support arm extends substantially horizontally relative to the ground and the new roll of web material is provided onto the second mandrel while the roll support arm is maintained in the roll-changing position.

According to exemplary methods for switching positions of rolls in a web material dispenser described herein, the housing comprises a cover member having an opening, during dispensing of web material, the cover member is closed against the back-wall member, the first and second rolls of web material supported on the first and second mandrels are partially enclosed within the housing, and at least a portion of each of the first roll of web material and the second roll of web material is accessible through the opening of the cover member; and providing the new roll of web material onto the second mandrel comprises: opening the cover member from the back-wall member prior to pivoting of the roll support assembly and rotating the roll support arm and closing the cover member against the back-wall member after rotating the roll support arm and after providing the new roll of web material.

According to exemplary methods for switching positions of rolls in a web material dispenser described herein, wherein the housing comprises a cover member having an opening, wherein during dispensing of web material, the cover member is closed against the back-wall member, the first and second rolls of web material supported on the first and second mandrels are partially enclosed within the housing, and at least a portion of each of the first roll of web material and the second roll of web material is accessible through the opening of the cover member, a smaller portion of the roll of web material in the secondary dispensing position being accessible through the opening than the roll of web material in the primary dispensing position, and wherein providing the new roll of web material in place of the depleted roll comprises: opening the cover member from the back-wall member prior to rotating the roll support arm and closing the cover member against the back-wall member after rotating the roll support arm and after placing the new roll of web material.

According to exemplary methods for switching positions of rolls in a web material dispenser described herein, the method further includes maintaining the roll support arm in a dispensing position thereof while the cover member is closed against the back-wall member, the roll support arm extending substantially vertically relative to the ground when in its dispensing position.

According to exemplary methods for switching positions of rolls in a web material dispenser described herein, providing the new roll of web material onto the second mandrel comprises inserting the new roll of web material onto the second mandrel in a sideways direction via an open side of the second mandrel.

BRIEF DESCRIPTION OF THE DRAWINGS

For a better understanding of the embodiments described herein and to show more clearly how they may be carried into effect, reference will now be made, by way of example only, to the accompanying drawings which show at least one exemplary embodiment, and in which.

Figure 1:
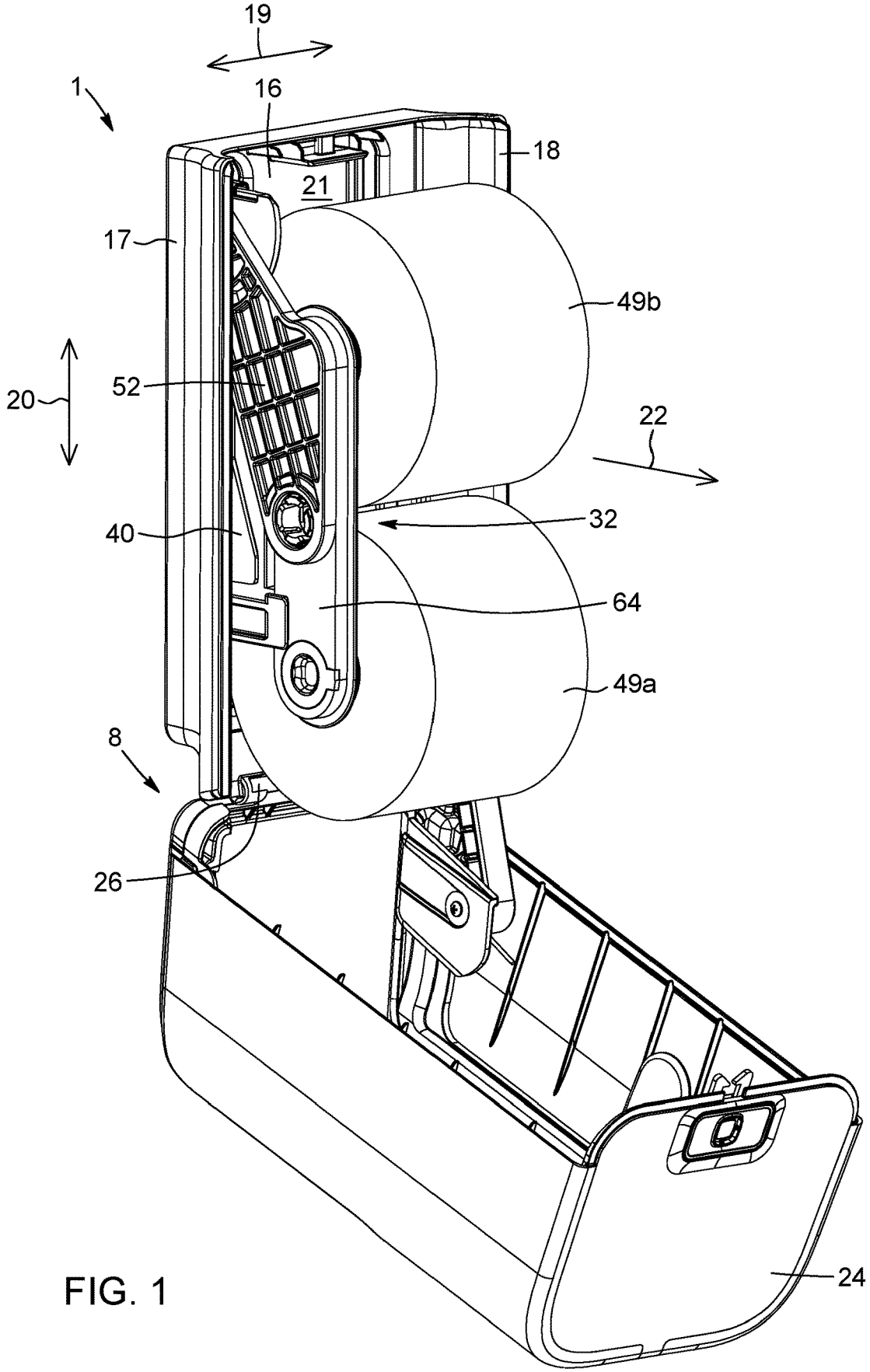
FIG. 1 illustrates a perspective view of a web material dispenser according to an example embodiment in an open state thereof.

It will be appreciated that for simplicity and clarity of illustration, elements shown in the figures have not necessarily been drawn to scale. For example, the dimensions of some of the elements may be exaggerated relative to other elements for clarity.

DETAILED DESCRIPTION

It will be appreciated that, for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art, that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any way but rather as merely describing the implementation of the various embodiments described herein.

The terms "coupled", "coupling", "attached", "attachment", or variants thereof as used herein can have several different meanings depending in the context in which these terms are used. For example, the terms coupled, coupling, attached, or attachment can have a mechanical connotation. For example, as used herein, the terms coupled, coupling, attached, or attachment can indicate that two elements or devices are directly connected to one another or connected to one another through one or more intermediate elements or devices via a mechanical element depending on the particular context.

FIG. 1 illustrates a perspective view of a web material dispenser 1 according to an example embodiment in an open state thereof. The web material dispenser 1 can be for example a paper or towel dispenser. In the illustrated embodiment, the dispenser is a toilet paper dispenser, but the other embodiments may encompass other types of web material dispensers, such as hand towel dispensers. The web material dispenser 1 includes a housing 8 for at least partially housing at least two rolls of web material, including a top roll and a bottom roll, such as paper rolls. In other embodiments, the housing 8 can house more than two rolls. For example, the dispenser can be a four-roll dispenser, with pairs of top and bottom rolls being located side by side in the dispenser.

According to the example embodiment illustrated in the figures, the housing 8 includes a back-wall member 16, having left and right sides and a cover member 24. In the illustrated example, the back-wall member 16 has a left sidewall 17 and a right sidewall 18.

Positional descriptions of the web material dispenser 1 can be defined relative to the back-wall member 16. A side-to-side direction 19 of the web material dispenser 1 corresponds to a direction 19 between the left and right sides of the back-wall member 16. A top-bottom direction 20 of the web material dispenser 1 corresponds to a direction 20 between top and bottom edges of the back-wall member 16. The side-to-side direction 19 and the top-bottom direction 20 further defines a backing plane corresponding to an inner surface 21 of the back-wall member 16. A forwardly or front-wise direction 22 of the web material dispenser 1 corresponds to a direction 22 oriented away from the inner surface 21 of the back-wall member 16.

Further according to the example embodiment illustrated in the figures, the cover member 24 is pivotally attached to the back-wall member 16, such as at their respective bottom portions (ex: at hinge 26, as illustrated in the figures). However, it will be understood that other mechanisms for mating the cover member 24 to the back-wall member 16 may be used. In other embodiments, the cover member 24 can be connected to one of the lateral sides of the housing (ex: to left sidewall 17 or right sidewall 18), or to a top portion of the housing.

In the open state of the web material dispenser 1, the cover member 24 is opened away from the back-wall member 16 to expose components of the web material dispenser 1 and/or to allow access to the rolls of web material, such as to replace depleted rolls or switch positions of the rolls. The back-wall member 16 can be coupled to a surface of an upstanding member, such as the surface of a bathroom wall.

According to one example, and as illustrated in the figures, the back-wall member 16 and the cover member 24 are further attached via a stopping arm 27 (FIGS. 10 to 17). The stopping arm 27 is operable to delimit the movement of the cover member 24 relative to the back-wall member 16. As illustrated, a lower end 28 of the stopping arm 27 is coupled to the cover member 24, such as a pivotal attachment of the lower end 28 to an inner member 29 of the cover member 24. An upper end 30 of the stopping arm 27 is coupled to back-wall member 16, such as a slidable attachment of the upper end 30 to a guide slot 31. When the cover member 24 is being opened, the upper end 30 of the stopping arm 27 slides downwardly along the guide slot 31 until it reaches a bottom end of the guide slot 31 (FIGS. 11 to 16), which further stops the movement of the cover member 24. When the cover member 24 is being closed, the upper end 30 of the stopping arm 27 sides upwardly along the guide slot 31 until the cover member 24 engages the back-wall member 16.

The stopping arm 27 can include a spring mechanism that provides a damping force when the cover member 24 is being moved from its closed position to its opened position. As the cover member 24 nears its fully opened position, as illustrated in FIG. 1, the spring mechanism of the stopping arm 27 enters a stretched state and causes an upward force that counteracts the force of gravity on the cover member 24, thereby providing the damping force. The damping forces reduces the speed at which the cover member 24 falls in the downward position as it is being opened.

The web material dispenser 1 further includes a roll support assembly 32 provided in the housing 8 that is operable to support at least two rolls of web material to be dispensed. The roll support assembly 32 is coupled to the housing 8. In the illustrated example, the roll support assembly 32 is coupled to the back-wall member 16. Furthermore, as illustrated in FIG. 1, the roll support assembly 32 is coupled to an interfacing member 40 that extends forwardly from the back-wall member 16. The interfacing member 40 may be considered as forming part of the housing 8, part of the roll support assembly 32, or as a separate element. It can be formed from a single component, or from several assembled components. The interface member 40 may be coupled to a left side or a right side of the housing. In an example, and as illustrated, the interfacing member 40 is clipped to one of the lateral sidewalls 17, 18 of the back-wall member 16. In other embodiments, the interfacing member 40 may be integrally formed with the housing 8, or affixed with screws or other types of attachments.

In the example illustrated in FIG. 1, two full rolls of web material 49*a*, 49*b* are being supported by the roll support assembly 32 and the web material dispenser 1 is almost ready for use.

Figure 2:
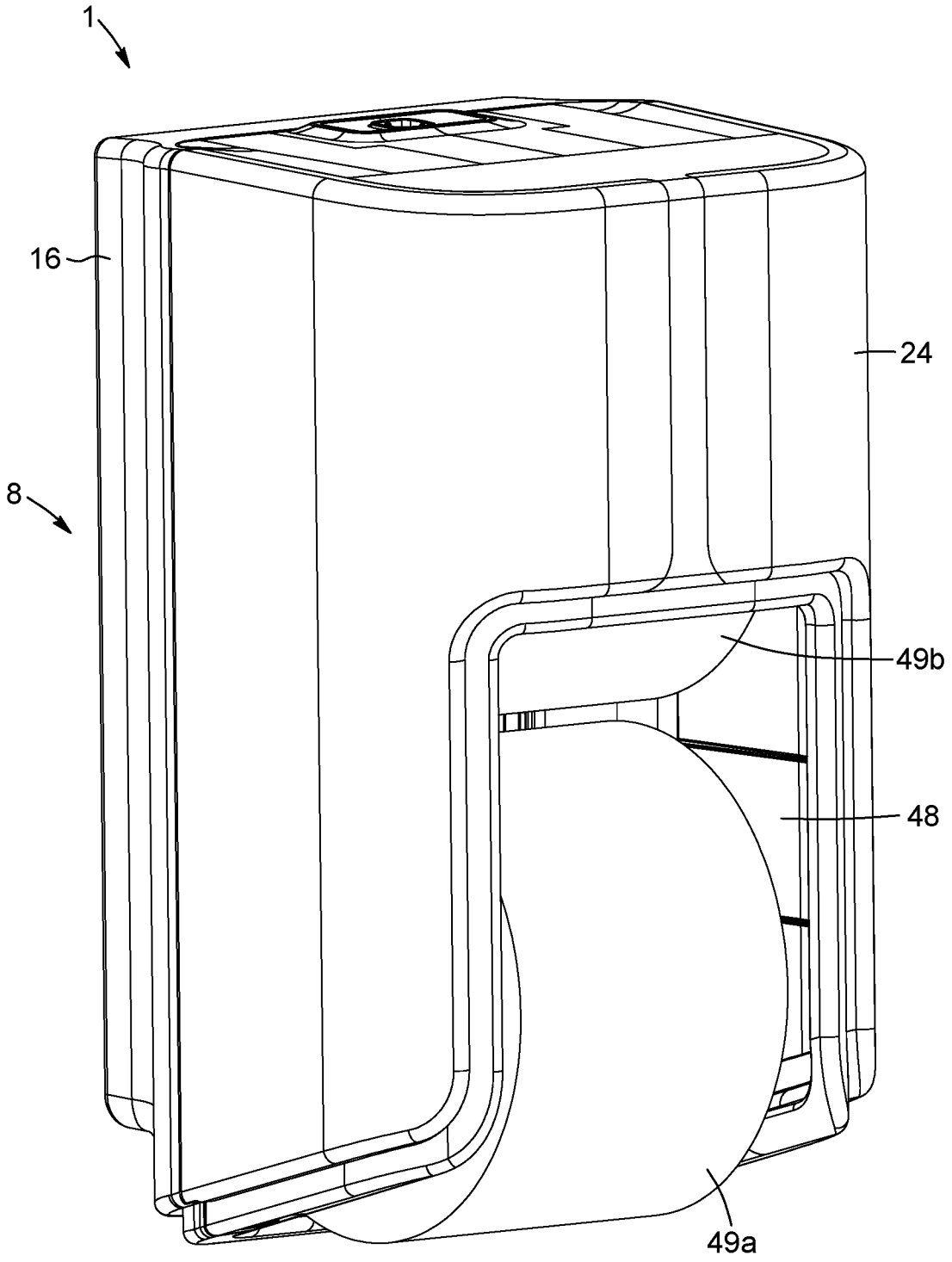
FIG. 2 illustrates a perspective view of the web material dispenser according to the example embodiment in a closed state thereof.
Figure 3:
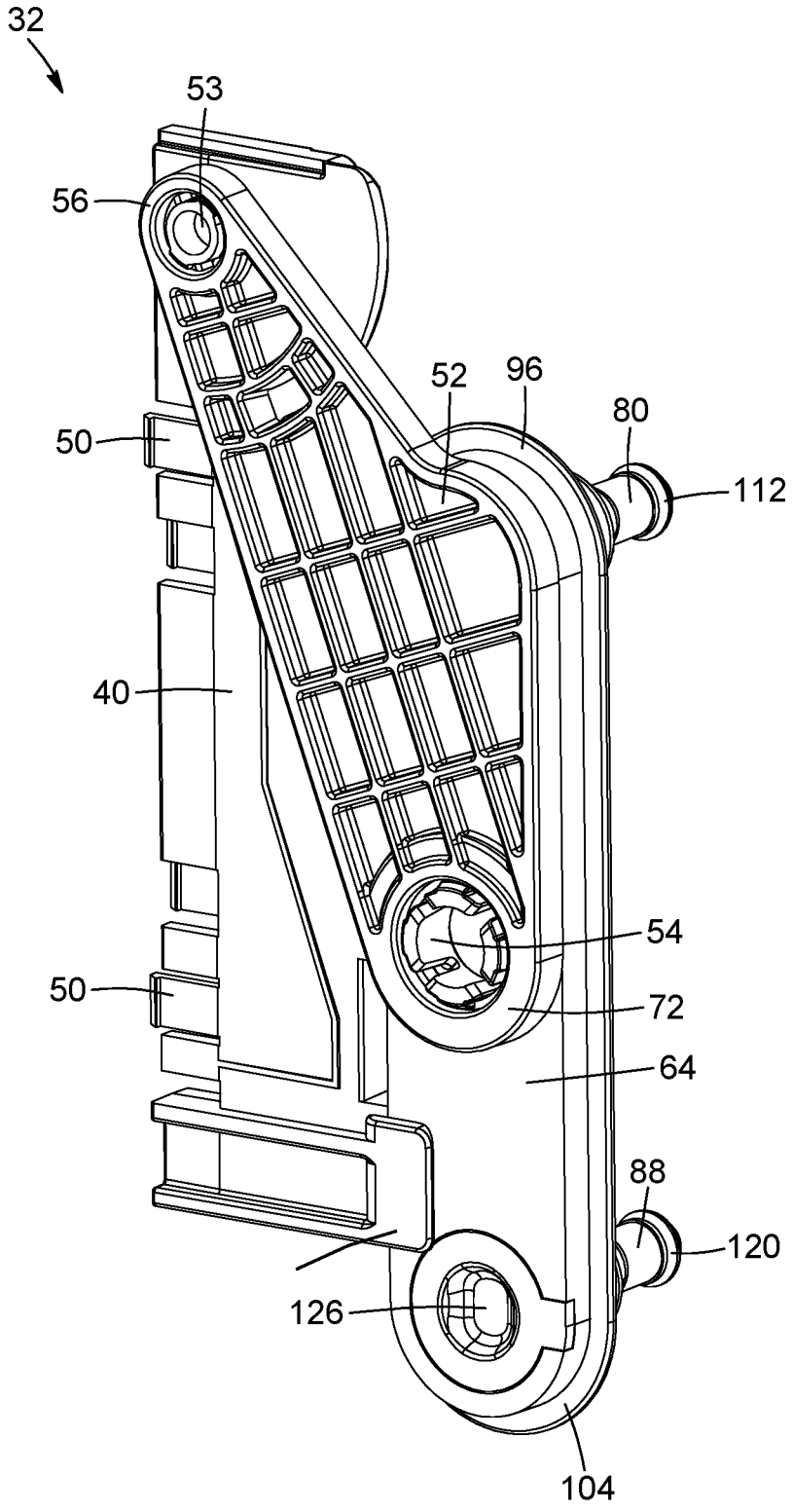
FIG. 3 illustrates a perspective view from a first side of a roll support assembly according to an example embodiment.

Referring now to FIG. 2, therein illustrated is the web material dispenser 1 in its closed state having two full rolls 49*a*, 49*b* of web material housed therein. The web material dispenser 1 enters its closed state from mating the cover member 24 to the back-wall member 16 to enclose components of the web material dispenser 1. As illustrated, the cover member 24 defines an opening 48 for accessing components located within the housing 8. In the illustrated example, the bottom roll 49*a* of web material, corresponding to a primary dispensing position, is accessible through the opening 48 and a partial portion of the top roll 49*b* of web material, corresponding to a secondary dispensing position, is also accessible through the opening 48. In other embodiments, the opening 48 can be provided only near the bottom side of the dispenser 1, and a door can be provided on the cover, to hide/protect the top roll, and a substantial portion of the bottom roll. In such embodiments, the cover can include a mechanism that allows the door to selectively provide access to the first or second roll, depending on the level of web material remaining on the rolls.

The primary dispensing position of a roll of web material (or a mandrel supporting the roll of web material) corresponds to a position of the roll within the housing 8 in which the web material of the roll is readily accessible by a user. The primary dispensing position can be the position that is aligned with the opening 48 of the cover member 24. In the example illustrated in FIG. 2, the bottom roll 49*a* is in the primary dispensing position and is aligned with the opening 48 provided in the bottom region of cover member 24.

The secondary dispensing position of a roll of web material (or a mandrel supporting the roll of web material) corresponds to a position of the roll within the housing 8 in which the web material of the roll serves as backup in case the web material of the roll in the primary dispensing position is depleted.

In one example embodiment, and as illustrated, the secondary dispensing position can be a position that is offset from the opening 48 of the cover member 24. A portion of the roll of web material in the secondary dispensing position may still be accessible through the opening 48, although the accessible portion of this roll is significantly less than the portion of the roll in the primary dispensing position that is accessible. In the example illustrated in FIG. 2, the top roll 49*b* is in the secondary dispensing position and is offset from the opening 48. However, a lower portion of the top roll 49*b* remains accessible through the opening 48 for use.

In other example embodiments, only the roll of web material in the primary dispensing position is accessible through the opening 48, and the other roll of web material housed within the housing 8 is only accessible when brought to the primary dispensing position.

The web material dispenser described herein according to various example embodiments is configured to permit the switching of the roll of web material in the primary dispensing position (or the mandrel supporting that roll) with the roll of web material in the secondary dispensing position (or the mandrel supporting that roll) so that the latter roll can be brought to the primary dispensing position.

Referring now to FIGS. 3 to 7, therein illustrated is a perspective view from a first side, a first side elevation view, a front elevation view, a second side elevation view and a perspective view from the second side, respectively, of a roll support assembly 32 according to an example embodiment. The interfacing member 40 according to an example embodiment is also illustrated.

The roll support assembly 32 is configured to be coupled to the housing 8. In the illustrated example, the roll support assembly 32 is coupled to the interfacing member 40, which can be further coupled to the housing 8. The interfacing member 40 may include clip members 50 for attaching to the housing 8, such as the back-wall member 16. Furthermore, the roll support assembly 32 may be pivotally attached to the housing 8 (ex: via interfacing member 40).

The roll support assembly 32 may include a linkage arm 52 being provided with a first attachment location 53 and a second attachment location 54. The linkage arm 52 is pivotally attached at its first attachment location 53 to the housing 8 (ex: via interfacing member 40). The linkage arm 52 has a generally elongated shape and extends forwardly from its attachment point (i.e. the first attachment location 53) to the housing 8. The linkage arm 52 can have a limited thickness in the side-to-side direction 19 to leave sufficient space for accommodating at least two full rolls of web material within the housing 8.

As illustrated, the first attachment location 53 of the linkage arm 52 at which it is pivotally attached to the housing 8 corresponds to a first end 56 of the linkage arm 52. This first attachment location 53 defines a pivot axis of the angular pivotal movement of the linkage arm 52. This pivot axis 53 represents a first pivot axis 53 of the roll support assembly 32. The pivot axis 53 can be parallel to the backing plane 21.

As described in more detail herein, the linkage arm 52 is operable to enter a linkage arm dispensing position, which corresponds to a first angular position of the linkage arm 52 about its pivot axis 53. In this position of the linkage arm 52, the rolls of web material supported by the roll support assembly 32 is operable to dispense web material. FIGS. 3 to 7 illustrate the linkage arm 52 in its dispensing position.

Figure 4:
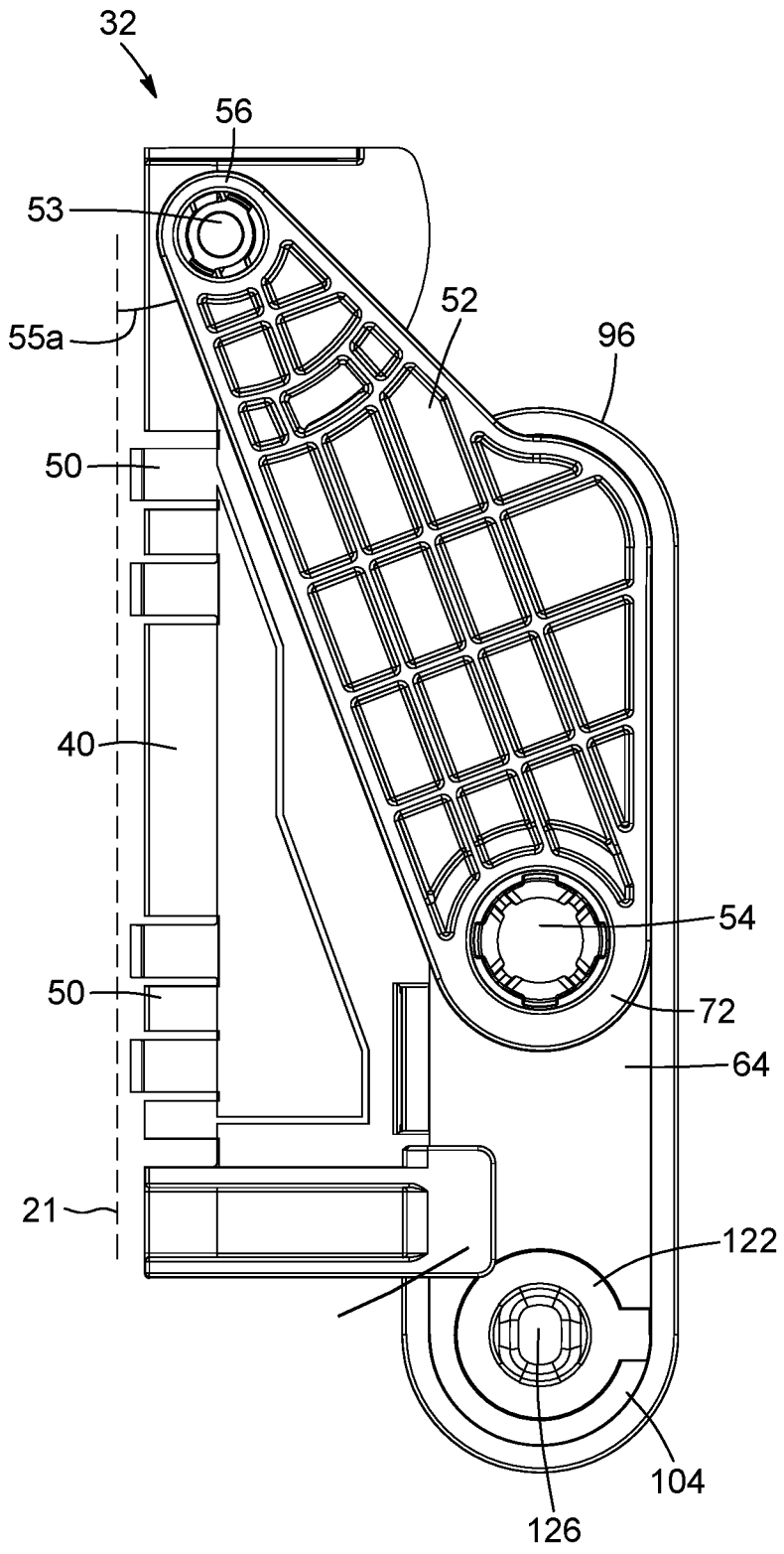
FIG. 4 illustrates a first side elevation view of the roll support assembly according to the example embodiment.

According to the illustrated example embodiment, in its dispensing position, the linkage arm 52 extends forwardly from the inner surface 21 of the back-wall member 16 (i.e. the backing plane) and, forms a first angle 55*a* with the inner surface 21, corresponding to the backing plane (FIG. 4).

The linkage arm 52 is also operable to enter a linkage arm roll changing position, which corresponds to a second angular position of the linkage arm 52 about its pivot axis 53. In this position of the linkage arm 52, the rolls of web material supported by the roll support assembly 32 is moved to a position that allows for changing the rolls of web material.

Figure 9A:
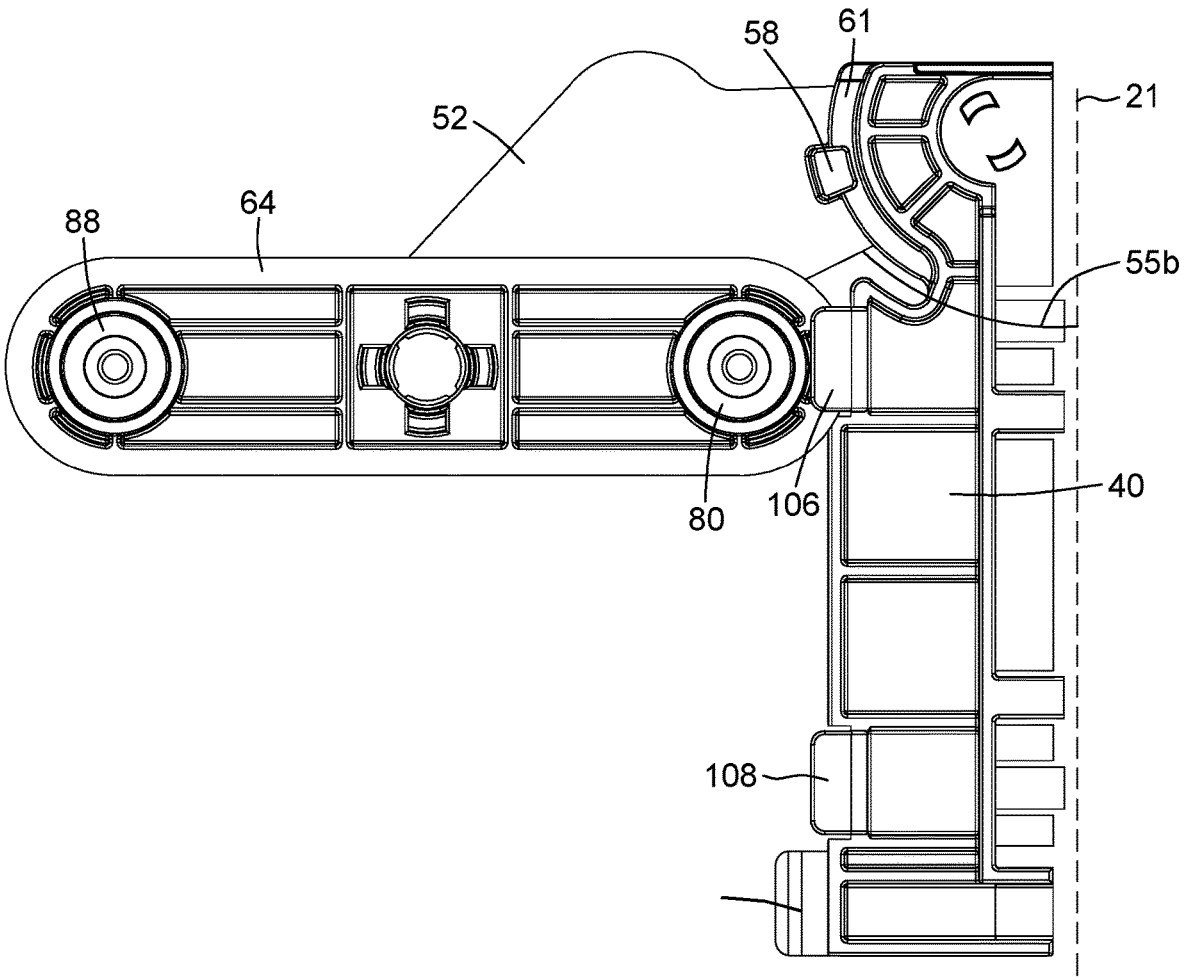
FIG. 9A illustrates a side elevation view of a roll support assembly and an interfacing member having a retaining mechanism according to an example embodiment.

According to the illustrated example embodiment, in its roll changing position, the linkage arm 52 extends further forwardly from the inner surface 21 of the back-wall member 16 (i.e. the backing plane) and, forms a second angle 55*b* with the inner surface 21, corresponding to the backing plane (FIG. 9A). The second angle 55*b* is greater (wider) than the first angle 55*a*.

According to one example embodiment, the linkage arm 52 is pivotally attached to the housing 8 at a fixed location of the housing 8. That is, during operation of the web material dispenser 1, the location on the housing 8 at which the linkage arm 52 is engaging the housing 8 is stationary. The linkage arm 52 can be attached to an upper region of the housing 8, as illustrated. However, it will be understood that the linkage arm 52 can be attached to a lower region of the housing 8 in other embodiments.

In an example embodiment, and as illustrated, one of the linkage arm 52 and the housing 8 (ex: interfacing member 40) includes a pivot pin that mates with a corresponding opening in the other of the linkage arm 52 and the housing 8 to form the pivotal attachment of the linkage arm 52 to the housing 8. The pivot pin and the corresponding opening can have a snapfitted connection, but other types of connections are contemplated.

According to an exemplary embodiment, the interfacing member 40 includes an arcuate guiding mechanism operable to guide the pivotal movement of the linkage arm 52 relative to the housing 8. The arcuate guiding mechanism of the interface member 40 can provide an arc-shaped path and the linkage arm 52 can have a follower element that engages the arcuate guiding mechanism along the arc-shaped path. The cooperating operation of the arcuate guiding mechanism of the interface member 52 with the follower element provides structural rigidity to the linkage arm 52 during its pivotal movement relative to the housing 8.

In an example embodiment, and as illustrated, the linkage arm 52 includes a hook member 58, corresponding to the follower element, extending from an interfacing surface 59 of an upper portion of the linkage arm 52. The hook member 58 and the interfacing surface 59 define a void 60 therebetween and a corresponding arc lip 61, corresponding to the arcuate guiding mechanism, of the interfacing member 40 is received within the void 60 to form a cooperative engagement with the hook member 58. The arc lip 61 defines an arc path and the hook member 58 is displaced along the arc path as the linkage arm 52 is pivoted angularly about the pivot axis 53. The cooperative engagement of the hook member 58 with the arc lip 61 provides mechanical support in guiding the pivoting action of the linkage arm 52. The arc lip 61 being received within the void 60 ensure that the linkage arm 52 stays connected to the interfacing member 40 during pivoting of the linkage arm 52.

Figure 8:
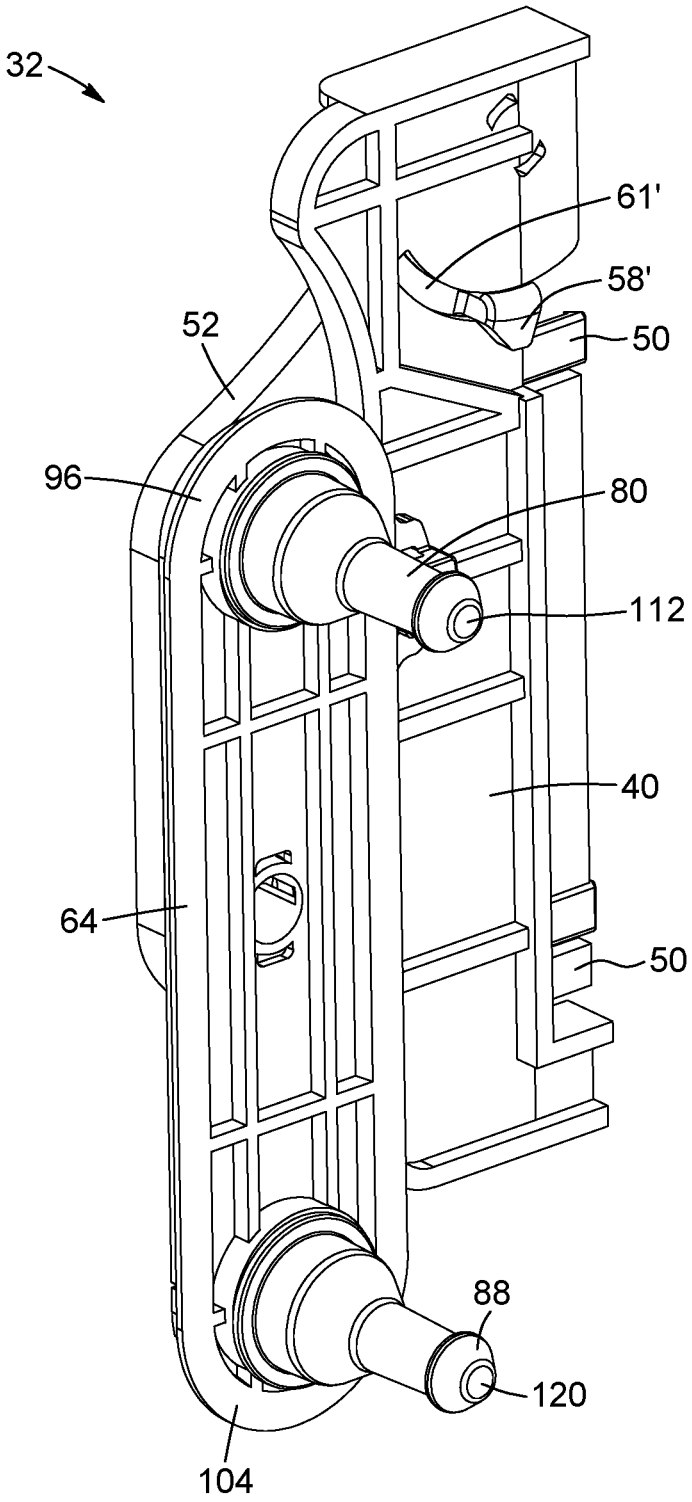
FIG. 8 illustrates a perspective view from the second side of the roll support assembly according to an alternative example embodiment.

According to an alternative embodiment of the roll support assembly 32, and as illustrated in FIG. 8 the linkage arm 52 includes a protruding tab 58' member, corresponding to the follower element, that extends into a corresponding arc guide slot 61', corresponding to the arcuate guiding mechanism, formed in the interfacing member 40 when the linkage arm 52 is suitably pivotally attached to the housing 8. The protruding tab 58' and the arc guide slot 61' provides mechanical support in guiding the pivoting action of the linkage arm 52. The protruding tab 58' further ensures that the linkage arm 52 stays connected to the interfacing member 40 during pivoting of the linkage arm 52.

The roll support assembly 32 further includes a roll support arm 64 that is pivotally attached within the roll support assembly 32. The location of the attachment of the roll support arm 64 to the roll support assembly 32 defines a pivot axis of the roll support arm 64 and the roll support arm 64 is operable to pivot about this pivot axis, which represents a second pivot axis of the roll support assembly 32.

According to one example embodiment, and as illustrated herein, the roll support arm 64 is pivotally attached to the linkage arm 52 at the second attachment location 54 of the linkage arm 52. Accordingly, the second attachment location 54 corresponds to a pivot axis 54 of the roll support arm 64. As further illustrated, this second location may be a second end 72 of the linkage arm 52. The pivot axis 54 can be parallel to the backing plane 21.

The roll support arm 64 has a generally elongated shape having a first end 96 and a second end 104. The roll support arm can have a length that is sufficient to accommodate two rolls of web material (ex: a length greater than two radii of rolls of web material). The roll support arm 64 can be substantially symmetrical.

It will be appreciated that the first attachment location 53 of the linkage arm 52 at which it is pivotally attached to the housing 8 is spaced apart and located remotely of the second attachment location 54 at which the roll support arm 64 is pivotally attached to the linkage arm 52. Accordingly, two separate pivot axes are defined. As the linkage arm 52 is pivoted about the first pivot axis 53 (at first attachment location 53) relative to the housing 8, the roll support arm 64 can be pivoted about the second pivot axis 54 (at second attachment location 54) relative to the linkage arm 52. The first pivot axis 53 and the second pivot axis 54 can be parallel with one another.

In one example embodiment, and as illustrated, the roll support arm 64 is pivotally attached to the roll support assembly 32 at a fixed location of the assembly 32. The roll support arm 64 may be attached to the linkage arm 52 at a fixed location of the linkage arm 52. That is, during operation of the web material dispenser 1, the location on the linkage arm 52 at which the roll support arm 64 is engaging the linkage arm 52 is not moving relative to the linkage arm 52.

The pivot axis 54 of the roll support arm 64, corresponds to the location at which it is pivotally attached to the second attachment location 54 of the linkage arm 52, can be located between the first and second ends 96 and 104 of the roll support arm 64. More particularly, the pivot axis 54 of the roll support arm 64 can be located at a midpoint between the first and second ends 96 and 104. It will be appreciated that in this case, the rotation of the roll support arm 64 about its pivot axis 54 is substantially balanced.

In an example embodiment, and as illustrated, one of the linkage arm 52 and the roll support arm 64 includes a pivot pin that mates with a corresponding opening in the other of the linkage arm 52 and the roll support arm 64 to form the pivotal attachment of the linkage arm 52 to the roll support arm 64. The pivot pin and the opening can have a snapfitted connection, but other types of connections are contemplated.

The web material dispenser 1 further includes a first roll support element, provided at a first location of the roll support assembly 32 and a second roll support element provided at a second location of the roll support assembly 32. The first roll support element can be a first mandrel 80 and is referred to hereinafter as the first mandrel 80, but it will be understood that other types of roll support elements are contemplated. Similarly, the second roll support element can be a second mandrel 88 and is referred to hereinafter as the second mandrel 88, but it will be understood that other types of roll support elements are contemplated.

The first mandrel 80 is operable to support a first roll of web material and the second mandrel 88 is operable to support a second roll of web material. Each mandrel 80, 88 projects into a central opening of a respective roll of web material to support that roll of web material. The roll of web material can have a core member, or may be coreless. The mandrel can be used with rolls of web material that include a bushing (or captivity mechanism) or not.

According to one example embodiment, and as illustrated, the first mandrel 80 extends transversely from a first end 96 of the roll support arm 64 and the second mandrel 88 extends transversely from a second end 104 of the roll support arm 64. The first mandrel 80 and the second mandrel 88 each extend in a direction along the pivot axis 54 of the roll support arm 64.

According to one example embodiment, and as also illustrated, the first and second mandrels 80, 88 are open-ended mandrels. That is, the extending end 112 of the first mandrel 80 is open and the first mandrel 80 can support a roll of web material by itself (i.e. without having to cooperate with another component at its extending end 112 to support the roll of web material). Similarly, the extending end 120 of the second mandrel 88 is open and the second mandrel 88 can support a roll of web material by itself. A roll of web material can be inserted in a sideways direction (along direction 19) onto the open-ended mandrel 80 or 88 via the open end/free end of the mandrel. This insertion can be carried out in an one-handed operation.

Figure 5:
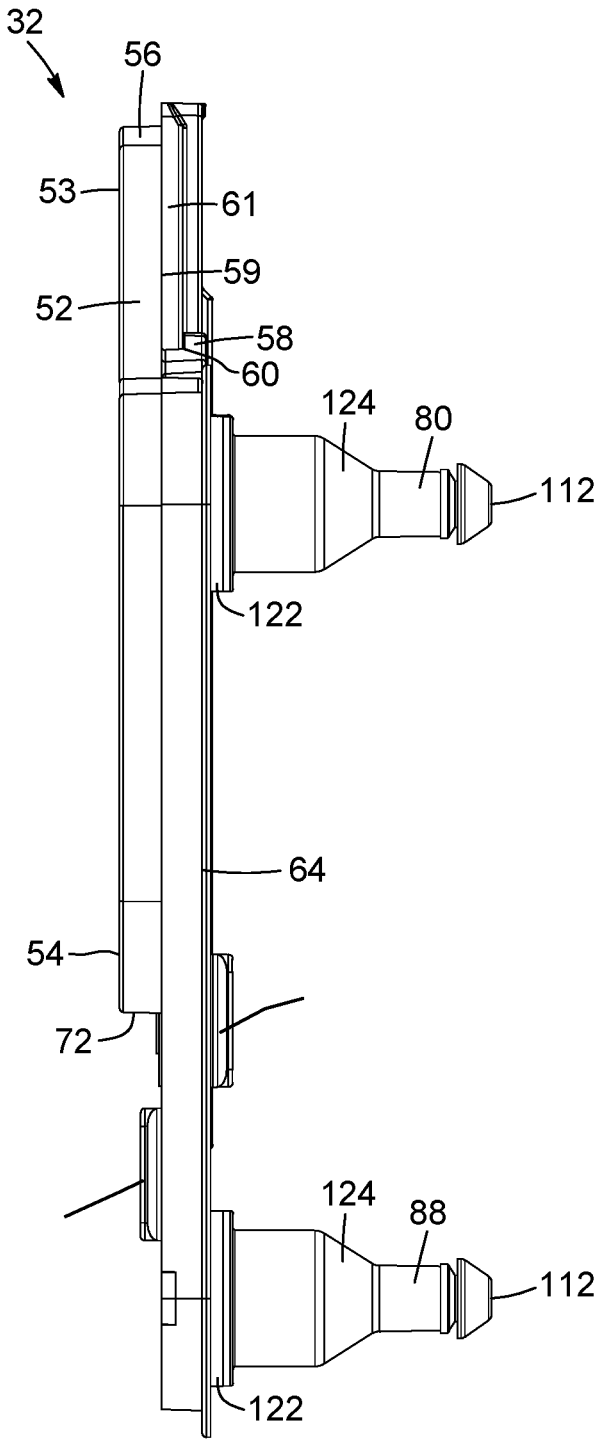
FIG. 5 illustrates a front elevation view of the roll support assembly according to the example embodiment.
Figure 6:
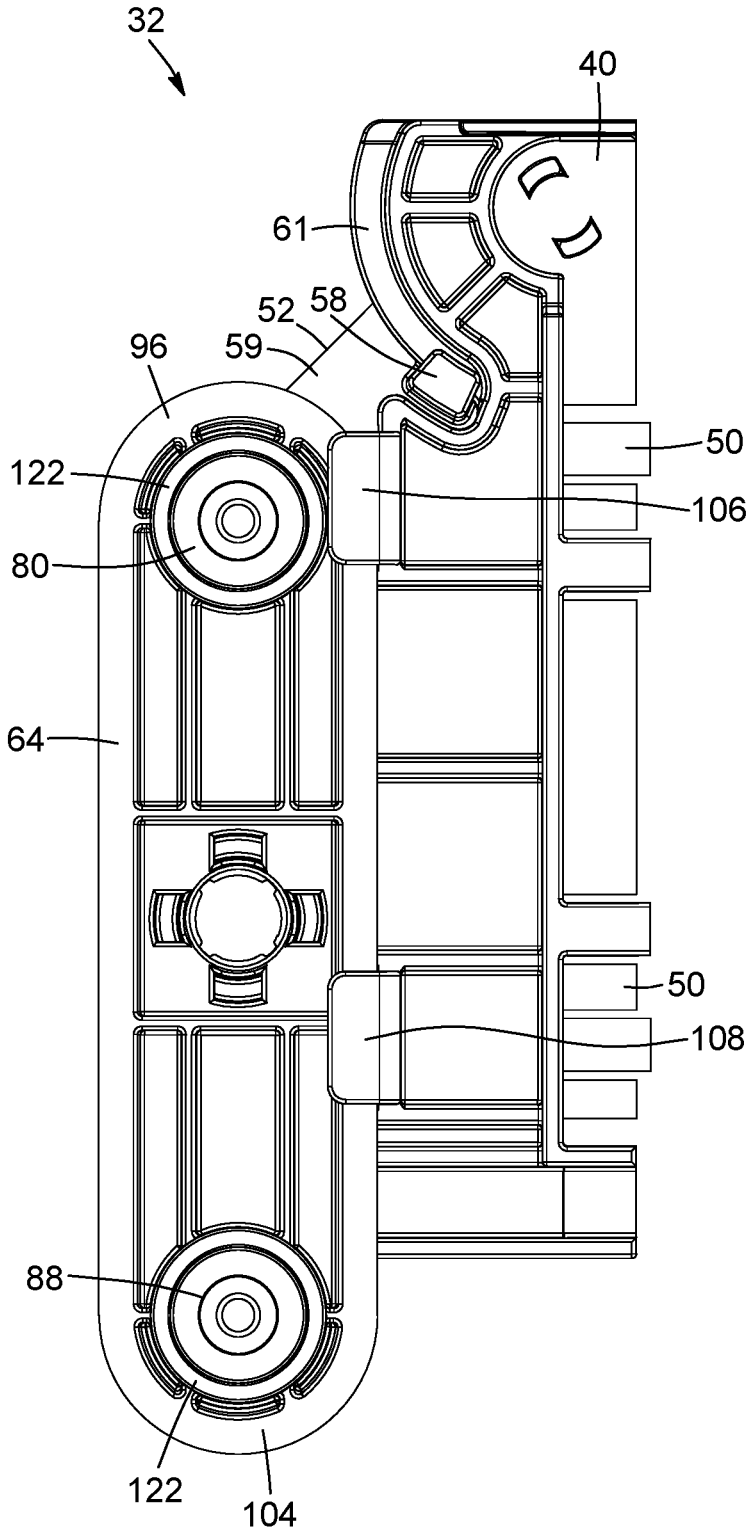
FIG. 6 illustrates a second side elevation view of the roll support assembly according to the example embodiment.

According to one example embodiment (as illustrated in FIG. 5), each of the first mandrel 80 and the second mandrel 88 includes a mandrel nut 122 that is positioned in a respective opening at a respective end 96, 104 of the roll support arm 64 and a mandrel bolt 124 threadedly engaging the mandrel nut 122 and having a portion extending from the roll support arm 64 to support a roll of web material. A back surface of the mandrel nut 122 can have a cavity 126 formed therein, which can receive the finger of an operator to engage the roll support arm 64. However, it will be understood that other configurations of the first mandrel 80 and second mandrel 88 are contemplated.

Figure 7:
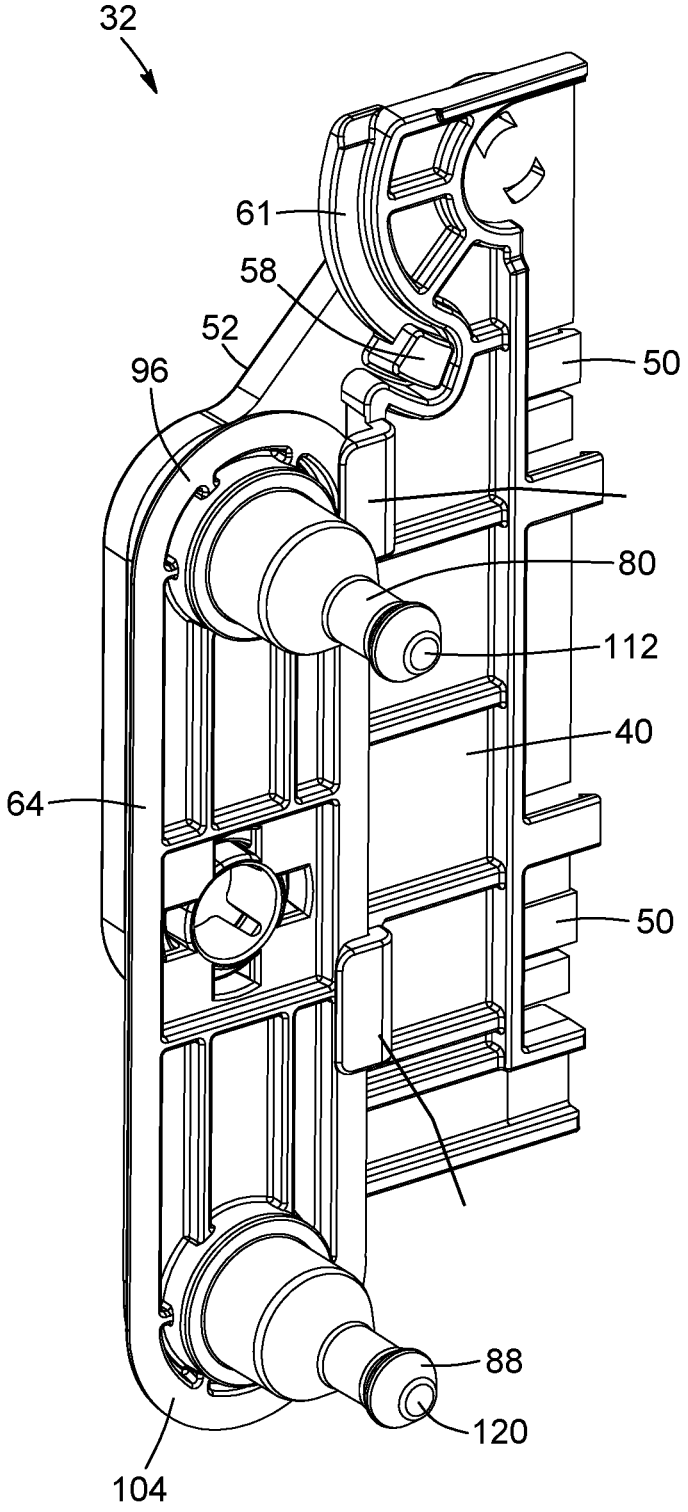
FIG. 7 illustrates a perspective view from the second side of the roll support assembly according to the example embodiment.

According to another example embodiment (as best seen in FIG. 7), each of the first mandrel 80 and the second mandrel 88 is snapfittedly connected to respective ends 96 and 104 of the roll support arm 64. The snapfit connections of the first and second mandrels 80, 88 can be permanent snapfit connections. Other suitable mechanisms for connecting the first mandrel 80 and second mandrel 88 to respective ends 96 and 104 are also contemplated.

Each of the first mandrel 80 and the second mandrel 88 can be rotatable about itself and relative to the roll support arm 64.

Alternatively, the first mandrel 80 and the second mandrel 88 are non-rotatable.

The roll support arm 64 can be operable to rotate about its pivot axis to selectively enter at least one support arm roll changing position and at least one support arm dispensing position.

A dispensing position corresponds to a given angular position of the roll support arm 64 about the pivot axis (ex: the second attachment location 54 of the linkage arm 52) in which the mandrels 80, 88 are positioned so at to facilitate dispensing material from one or both of the rolls of web material supported on the mandrels 80, 88. In one example embodiment, the roll support arm 64 can enter a plurality of dispensing positions, corresponding to different angular positions about the pivot axis. The roll support arm 64 may selectively enter two dispensing positions. A first of the dispensing positions promotes dispensing of material from the roll of web material being supported on a first of the mandrels 80, 88 and a second of the dispensing positions promotes dispensing of material from the roll of web material being supported on a second of the mandrels 80, 88.

In one example embodiment, and as illustrated, a dispensing position corresponds to an angular position of the roll support arm 64 about the pivot axis 54 in which one of the mandrels is located above the other of the mandrels. For example, FIGS. 1 and 2 show the roll support arm 64 in one of the dispensing positions wherein a first roll supported on one of the mandrels 80, 88 is located immediately above a second roll of web material supported on a second of the mandrels 80, 88. When the cover member 24 is closed, dispensing from the second (lower positioned) roll of web material is promoted because it is easier to access through the opening 48, but the first (higher positioned) roll of web material is also accessible through the opening 48.

It will be appreciated that in the dispensing position, the roll support arm 64 extends substantially vertically relative to the ground. The ground can correspond to a underlying on which a user using the web dispenser 1 would be standing or seated. It will be appreciated that in this dispensing position, the roll support arm 64 is aligned with a lateral side of the housing and/or with the inner surface 21 of the back-wall member 16 defining the backing plane.

A first dispensing position of the roll support arm 64, with the linkage arm 52 also in its dispensing position, can correspond to a position in which the first mandrel 80 is located above the second mandrel 88. As described elsewhere herein, in this configuration, the roll of web material supported on the second mandrel 88 is in a primary dispensing position of the web material dispenser 1 and the roll of web material supported on the first mandrel 80 is in a secondary dispensing position of the web material dispenser 1.

A second dispensing position of the roll support arm 64, with the linkage arm 52 also in its dispensing position, can correspond to a position in which the second mandrel 88 is located above the first mandrel 80. As described elsewhere herein, in this configuration, the roll of web material supported on the first mandrel 80 is in the primary dispensing position of the web material dispenser 1 and the roll of web material supported on the second mandrel 88 is in the secondary dispensing position of the web material dispenser 1.

Furthermore, the mandrels 80, 88 may be maintained at a fixed position relative to one another and relative to the housing 8 when the roll support arm 64 is in the support arm dispensing position for dispensing material. Similarly, the linkage arm 52 and the roll support arm 64 are both maintained in a respective fixed position when the cover member 24 is in the closed position and the web material dispenser 1 is ready for use to dispense material.

Referring back to FIGS. 3 to 7, a roll changing position corresponds to a given angular position of the roll support arm 64 about the pivot axis in which the mandrels 80, 88 are positioned so as to facilitate changing the rolls of web material supported thereon. In one example embodiment, the roll support arm 64 can enter a plurality of roll changing positions, corresponding to different angular positions about the pivot axis. The roll support arm 64 may selectively enter two roll changing positions. A first of the roll changing positions allows easy replacement of the roll of web material being supported on a first of the mandrels 80, 88 and a second of the roll changing positions allows easy replacement of the roll of web material being supported on a second of the mandrels 80, 88.

In one example embodiment, a roll changing position corresponds to an angular position of the roll support arm 64 about the pivot axis 54 in which one of the mandrels 80, 88 is located forwardly of the other of the mandrels 88, 80 relative to the back wall member 16. The roll changing position of the roll support arm 64 may be a position in which the roll support arm 64 extends substantially horizontally relative to the ground.

A first roll changing position of the roll support arm 64, with the linkage arm 52 also in its roll changing position, can correspond to a position in which the second mandrel 88 is located forwardly of the first mandrel 80, relative to the back wall member 16. This exposes the second mandrel 88, thereby facilitating swapping of the roll of web material supported on the second mandrel 88.

A second roll changing position of the roll support arm 64, with the linkage arm 52 also in its roll changing position, can correspond to a position in which the first mandrel 80 is located forwardly of the second mandrel 88, relative to the back wall member 16. This exposes the first mandrel 80, thereby facilitating swapping of the roll of web material supported on the first mandrel 88.

It will be understood that according to some example embodiments, the swapping of a roll of web material on any of the mandrels during operation does not necessarily have to occur while the roll support arm 64 is in its roll changing position and the linkage arm 52 is in its roll changing position. Any roll of web material can also be swapped when the linkage arm 52 and the roll support arm 64 are in one of their dispensing positions. An operator can choose the position of the linkage arm 52 and the position of the roll support arm 64 at which the operator carries out swapping of a roll of web material based on their own preference.

According to an example embodiment, the roll support assembly 32 and/or housing 8 includes a retaining mechanism adapted to lock in place the roll support arm 64 at its at least one dispensing position and/or at least one roll changing position. The retaining mechanism can counteract a level of pivotal force of the roll support arm 64 when the arm 64 enters its dispensing position and/or roll changing position. This level of pivotal force corresponds to the force that is applied from the rolls of web material supported on the mandrels 80, 88 being of unequal weight. The retaining mechanism is further adapted to allow further pivoting of the roll support arm 64 upon an application of force, for example from a human operator, that is greater than the retaining force of the retaining mechanism.

In one example embodiment, one or more of the linkage arm 52 and the roll support arm 64 can have at least one indentation formed therein and the other of the arms 52, 64 can have at least one corresponding notched formed therein to form the retaining mechanism. The roll support arm 64 is retained in place relative to the linkage arm 52 when one of the indentations is received within and forms an engagement with one of the notches. The application of the force, for example from the human operator, causes the disengagement of the indentation from the notch, which allows further pivoting of the roll support arm 64.

Figure 9B:
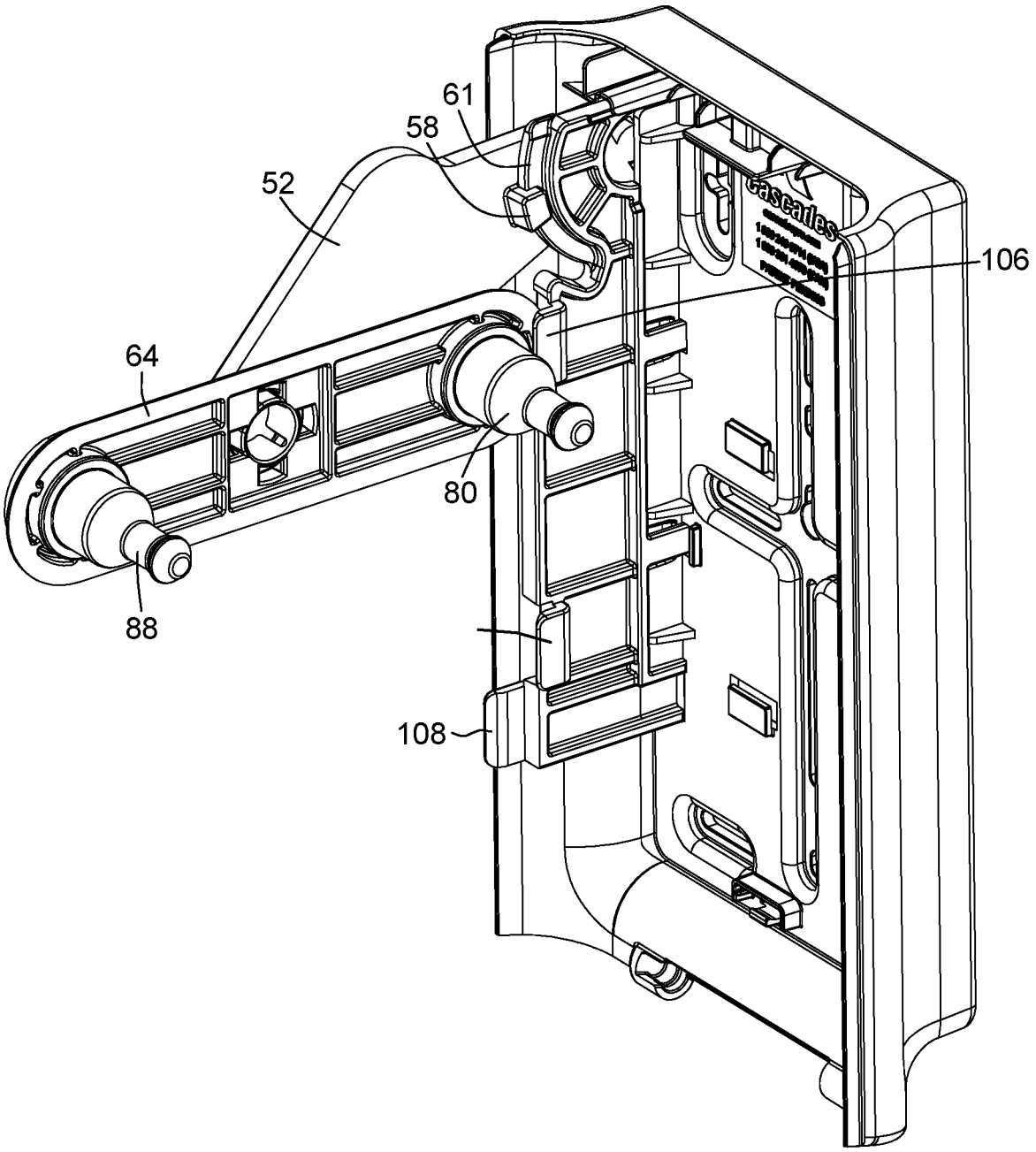
FIG. 9B illustrates a perspective view of the roll support assembly and the interfacing member having the retaining mechanism according to the example embodiment.

Referring now to FIGS. 6, 7, 9A and 9B, therein illustrated is a side elevation view and perspective view of the roll support assembly 32 and interfacing member 40 according to an example embodiment. The roll support arm 64 is illustrated in one of its dispensing positions in FIGS. 6 and 7. In FIGS. 9A and 9B, the roll support arm 64 is illustrated in one of its roll changing positions. A plurality of tabs (ex: tabs 106, 108 and 110) are provided on a front edge of interfacing member 40 and are operable to provide lateral support to the roll support arm 64 in the side-to-side direction 19 (identified in FIG. 1) when the roll support arm 64 is in one of its dispensing positions. The tabs 106, 108, 110 abut side surfaces of the roll support arm 64 and restrict the side-to-side movement of the roll support arm 64. It will be understood that the side-to-side movement of the roll support arm 64 may otherwise be caused by flexing of the linkage arm 54 and/or the roll support arm 64 (ex: due to the weight of the rolls of web material supported thereon).

In one example embodiment, the tab 106 can also act as a retaining mechanism. As shown in FIGS. 9A and 9B, the tab 106 is located along the angular path of the ends 96, 104 of the roll support arm 64. At the angular positions of the roll support arm 64 corresponding to its roll changing positions, one of the ends 96, 104 engages the tab 106 and may be retained in place by the tab 106. For example, the roll support arm 64 may frictionally engage the tab 106 or snapfittedly engage the tab 106. The application of the force, for example from the human operator, causes the disengagement of the end 96 or 104 of the roll support arm 64 from the tab 106.

The roll support assembly 32 described herein provides for switching the position of one of the mandrels (and the roll of web material supported thereon) with the position of the other of the mandrels (and another roll of web material supported thereon). As described, a given mandrel being positioned in the primary dispensing position can be switched to the secondary dispensing position while another mandrel being positioned in the secondary dispensing position can be switched to the primary dispensing position.

The switching of the positions of the mandrels 80, 88 (from primary dispensing position to secondary dispensing position, and vice versa) can be carried out by pivoting the linkage arm 52 relative to the housing 8 to bring the linkage arm 52 from its dispensing position to its roll changing position. It will be appreciated that in the roll-changing position, the linkage arm 52 extends further forwardly and its angle 55*b* relative to the backing plane 21 is greater than the position of the linkage arm 52 when in its dispensing position. This roll changing position of the linkage arm 52 provides clearance for the roll support arm 64 to pivot about its pivot axis 54.

The switching of the positions of the mandrels can further be carried out by rotating the roll support arm 64 about its pivot axis 54 while the linkage arm 52 is in its roll changing position. More particularly, the roll support arm 64 can be rotated from its first support arm roll dispensing position to its second support arm roll dispensing position, or vice versa. It will be appreciated that this rotation causes a first mandrel 80 of the roll support arm 64, after the rotation is complete, to have the position that the second mandrel 88 had occupied prior to the rotation. Similarly, this rotation causes the second mandrel 88, after the rotation is complete, to have the position that the first mandrel 80 had occupied prior to the rotation. Accordingly, positions of the first and second mandrels 80, 88 are switched from the rotation. After completing rotation of the roll support arm 64, the linkage arm 52 can be further pivoted back to its linkage arm dispensing position. During the pivoting of the linkage arm 52 and the rotation of the roll support arm 64, a new roll of web material can be provided onto one of the mandrels 80, 88.

In the illustrated example, the first attachment location 53 of the linkage arm 52, corresponding to the first pivot axis of the roll support assembly 32 and the pivot axis of the linkage arm 52, is located above the second attachment location 54 of the linkage arm 52, corresponding to the second pivot axis of the roll support assembly 32 and the pivot axis of the roll support arm 64. This relative position of the first and second pivot axes promotes the linkage arm 52 to be returned to its dispensing position from the force of gravity, which can provide more stability within the roll support assembly 32.

However, it will be understood that in other embodiments, the first pivot axis 53 can be located below the second pivot axis 54, such as having the first attachment location 53 of the linkage arm 52 being attached to a lower region of the back-wall member 16 and the linkage arm 52 extending upwardly from the first attachment location 53.

Figure 16:
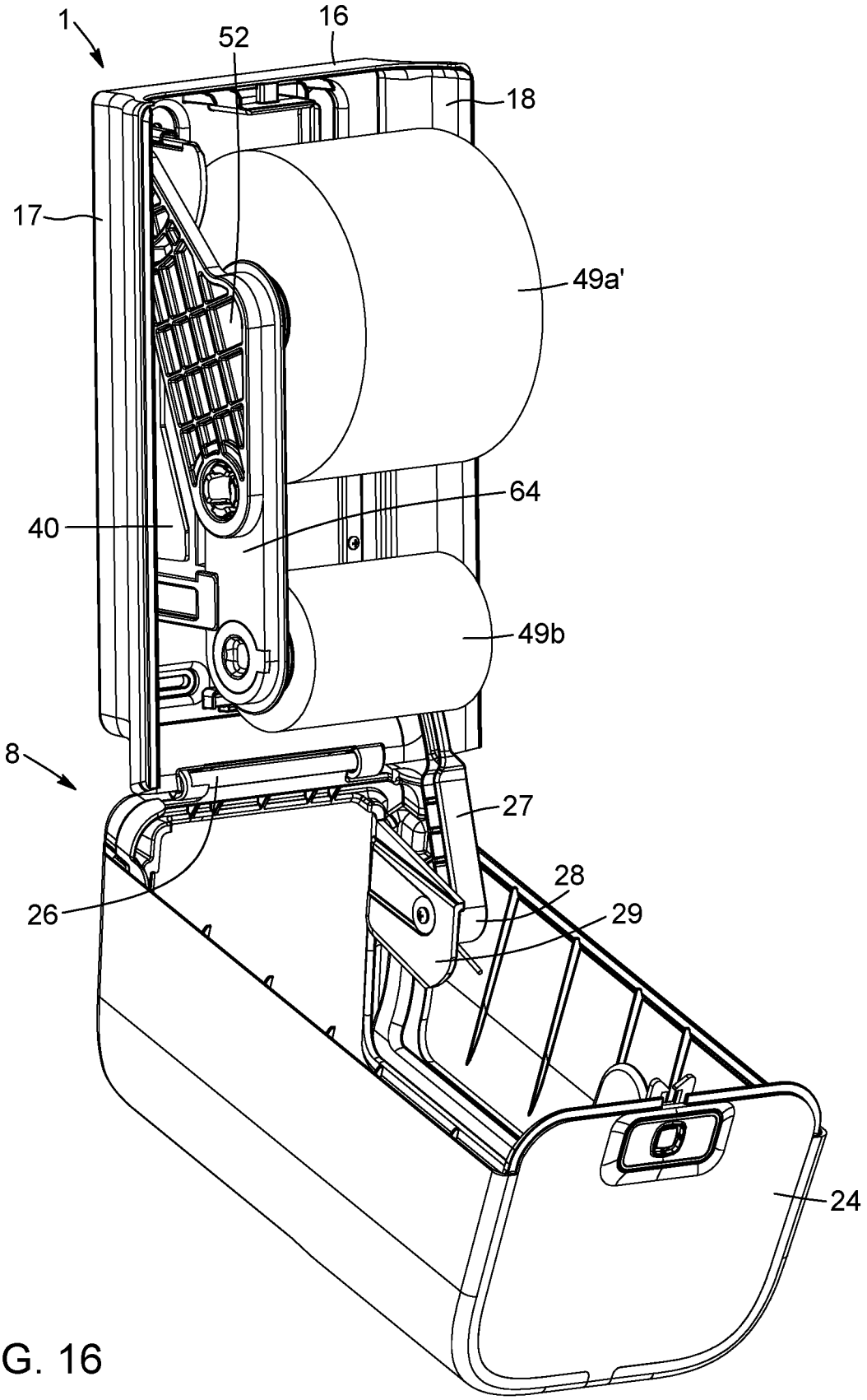
FIG. 16 illustrates a perspective view of the web material dispenser according to the example embodiment, with the previously depleted roll having been provided or replaced with a full roll of web material.
Figure 17:
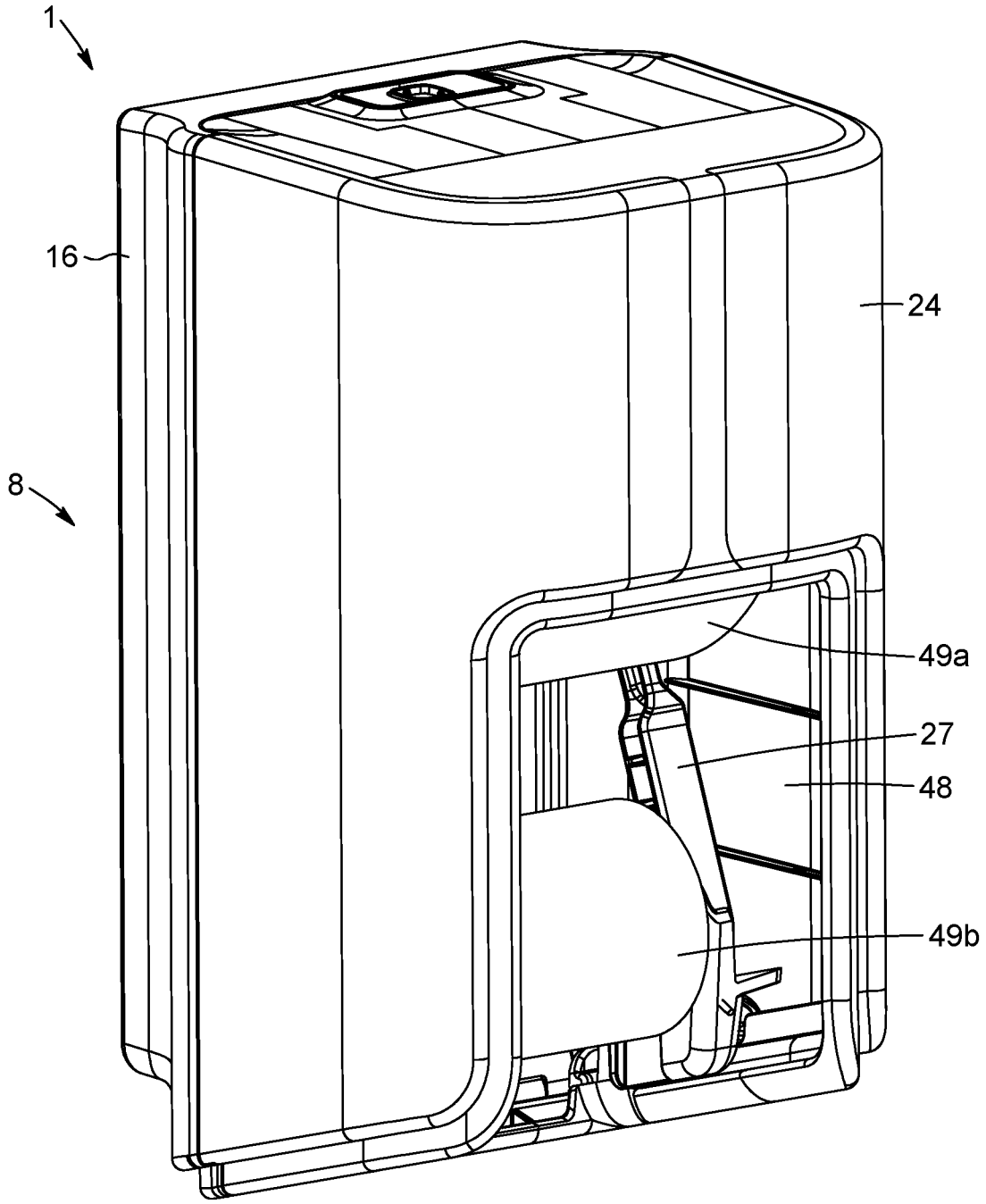
FIG. 17 illustrates a perspective view of the web material dispenser according to the example embodiment being ready for use.

A method of switching positions of rolls in a web material dispenser will now be explained. The method includes providing a web dispenser 1 according to various examples described herein. Accordingly, the web dispenser 1 includes a housing 8 for housing first and second rolls of web material. The method further includes providing a roll support assembly 32 pivotally attached to the housing 8, in which the roll support assembly 32 includes a roll support arm 64 having first and second ends 96, 104, a first mandrel 80 provided at the first end 96 of the roll support arm 64 and for supporting a first roll of web material and a second mandrel 88 provided at the second end 104 of the roll support arm 64 for supporting the second roll of web material. The method further includes pivoting the roll support assembly 32 away from a back-wall member 16 of the housing 8, to provide clearance for the support arm to pivot/rotate. An illustration of pivoting the roll support assembly 32 away from a rear end of the housing is provided by FIGS. 11 and 12. The roll support assembly 32 is moved away from the roll housing region of the dispenser, via a pivoting motion. In the illustrated embodiment, the motion is an upward pivoting motion, but in other configurations, pivoting the roll support assembly can be performed in a downward motion, depending on the location of the roll support assembly pivoting axis/pivot point. The method also includes rotating the roll support arm 64 about a pivot axis thereof, to move the first roll of web material, which may be a non-depleted at the time of the rotating, to take the place of the second roll of web material, which typically corresponds to a depleted roll at the time of rotating. This rotational motion of the roll support arm is illustrated from FIGS. 12 to 15. The method may further include providing a new roll of web material onto the second mandrel 88, as shown in FIG. 16. The method also includes, subsequent to providing the new roll of web material onto the second mandrel 88, pivoting the roll support assembly 32 back in the housing, toward the back-wall member 16, as illustrated in FIG. 17.

It will be understood that the steps of the method are not necessarily carried out in the order set out above and some steps can be carried out of order. For example, the providing of the new roll of web material onto the second mandrel can be carried out prior to, during (as an intermediate step), or after the rotating of the roll support arm 64.

Prior to pivoting the linkage arm 52 and prior to rotating the roll support arm 64, the second mandrel 88 is initially in the primary dispensing position and is supporting the second roll that has become depleted and the first mandrel is initially a secondary dispensing position (and can be full, non-depleted or partly depleted). Subsequent to rotating the roll support arm 64, the second mandrel 88 reaches the secondary dispensing position and the first mandrel 80 reaches the primary dispensing position. Accordingly, the non-depleted first roll of web material is in the primary dispensing position and is ready use. The new roll of web material provided onto the second mandrel 88 is in the secondary dispensing position.

As described with reference to the figures, the primary dispensing position is located below the secondary dispensing position relative to the ground. During use, after providing the new roll of web material onto the secondary mandrel 88, the roll support arm 64 is maintained in its dispensing position while the cover member 24 is closed against the back-wall member 16. The roll support arm 64 extends substantially vertically relative to the ground when in this dispensing position.

The method may further include rotating the roll support arm 64 to a roll-changing position thereof. This rotation can correspond to a portion of the rotating step of the roll support arm 64 to move the first roll of web material to take the place of the second roll of web material. In the roll changing position of the roll support arm 64, the second mandrel is located forwardly of the first mandrel 80 relative to the back-wall member 16 and the roll support arm 64 extends substantially horizontally relative to the ground. The new roll of web material can be provided onto the second mandrel while the roll support arm is maintained in this roll changing position.

During the dispensing of web material, such as prior to carrying out the method to switch the positions of rolls in the web material dispenser, the cover member 24 of the housing 8 is closed against the back-wall member 16. The rolls of web material supported on the first and second mandrels 80, 88 are partially enclosed within the housing 8 and at least a portion of each the rolls of web material is accessible through the opening of the cover member. The portion of the roll of web material in the secondary dispensing position that is accessible through the opening of the cover member is smaller or less than the portion of the roll of web material in the primary dispensing position that is accessible through the same opening. The providing the new roll of web material onto the second mandrel includes opening the cover member 24 from the back-wall member 16 prior to pivoting of the roll support assembly 32 and rotating the roll support arm 64. The providing the new roll of web material also includes closing the cover member 24 against the back-wall member 16 after rotating the roll support arm 64 and after providing the new roll of web material onto the second mandrel 88.

Providing the new roll of web material onto the second mandrel can include inserting the new roll of web material onto the second mandrel in a sideways direction through the open side of the second mandrel.

Figure 10:
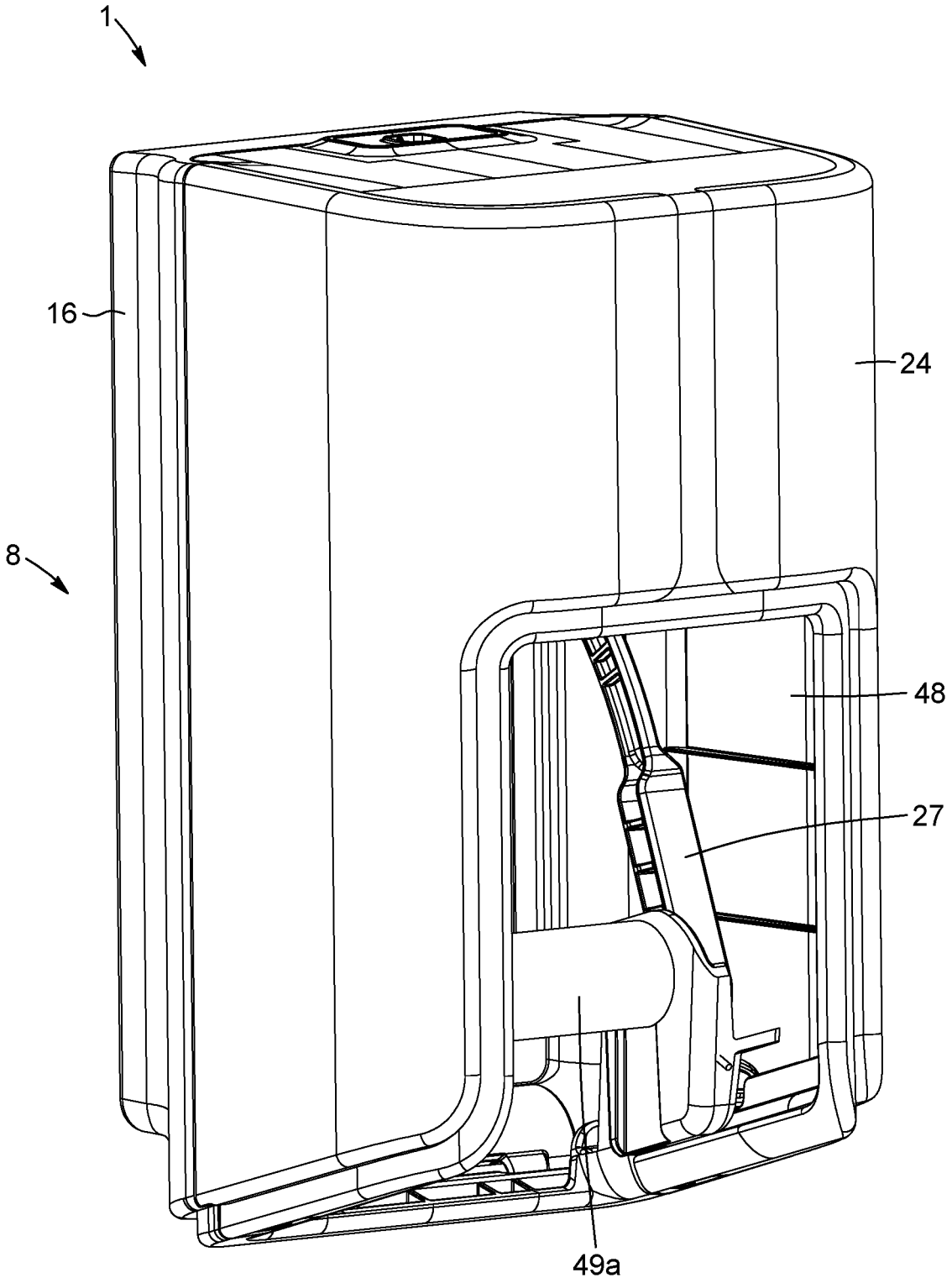
FIG. 10 illustrates a perspective view of the web material dispenser according to an example embodiment in an empty state and the cover member in a closed position.

Referring now to FIG. 10, therein illustrated is a perspective view of the web material dispenser 1 according to an example embodiment in an empty state and the cover member 24 in a closed position. In this state, at least one of the rolls of web material being supported by the mandrels 80, 88 is empty or approaching empty (ex: stub roll state) such that the roll of web material should be replaced. In the illustrated example, roll of web material 49*a* located in the primary dispensing position is depleted and requires replacing.

Figure 11:
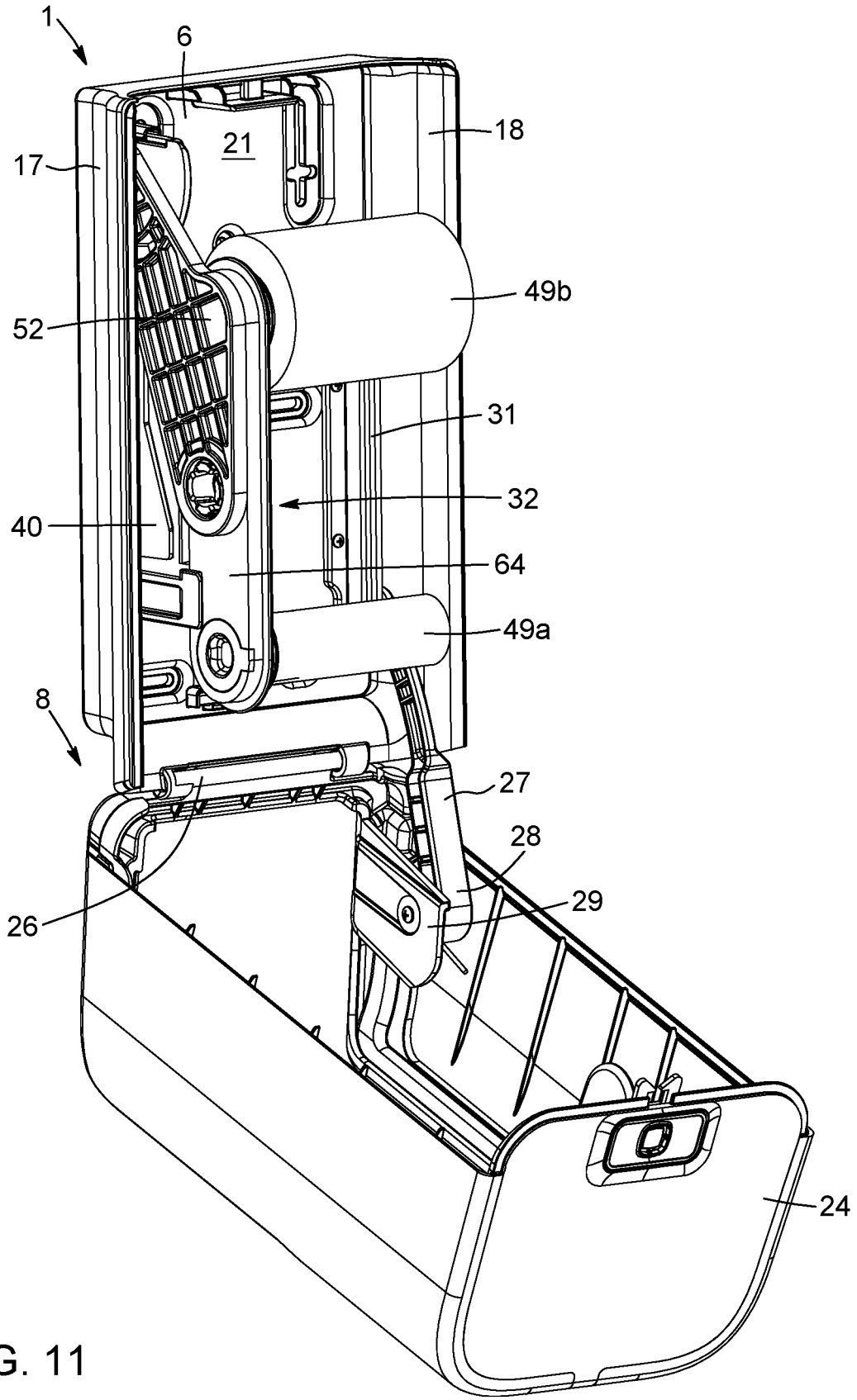
FIG. 11 illustrates a perspective view of the web material dispenser according to the example embodiment, with the bottom roll being depleted, the cover member in the open position, the linkage arm in its dispensing position and the roll support arm in a first roll support dispensing position.

Referring now to FIG. 11, therein illustrated is a perspective view of the web material dispenser 1 according to the example embodiment in the depleted state and the cover member 24 in the open position. In the open position of the cover member, the linkage arm 52 and the roll support arm 54 can both be pivoted to replace the first or second rolls of web material when depleted and/or to switch positions of the first and second rolls of web material relative to the opening. FIG. 11 further illustrates the linkage arm 52 in a linkage arm dispensing position and the roll support arm 64 in a support arm dispensing position. It will be appreciated that these positions of the linkage arm 52 and the roll support arm 64 correspond to the positions that the linkage arm 52 and the roll support arm 64 would take when dispensing material. It will be further understood that FIG. 11 illustrates a first intermediate state of a method for using the web material dispenser 1 to switch the positions of the rolls in the web dispenser 1. To reach this first intermediate state from the dispensing state (as illustrated in FIG. 10), an operator operates the cover member 24 to move it to its open position. This operation of opening the cover member 24 can be a one-handed operation.

FIG. 11 illustrates the roll support arm 64 in a first roll support dispensing position. It will be appreciated that the first mandrel 80 holds a partially used roll 49*b* (i.e. a non-depleted roll) that is located in a secondary dispensing position. In this secondary dispensing position, the first mandrel 80 and the partially used roll 49*b* is located above the second mandrel 88 holding the depleted roll 49*a*. The secondary dispensing position denotes the mandrel/roll of web material that is located in the upper position within the web material dispenser 1 when the linkage arm 52 is in its dispensing position and the roll support arm 64 is also in one of its dispensing positions. The primary dispensing position denotes the mandrel/roll of web material that is located in the lower position within the web material dispenser 1 when the linkage arm 52 is in its dispensing position and the roll support arm 64 is also in one of its dispensing positions. It will be appreciated that when the cover member 24 is closed, as illustrated in FIGS. 2 and 10, the roll of web material located in the primary dispensing position is more easily accessible through the opening 48 than the roll of web material located in the secondary dispensing position. For example, whereas a significant portion of the roll of web material in the primary dispensing position can be accessed through the opening 48, a much smaller portion of the roll of web material in the secondary dispensing position is accessible though the opening 48. In the state illustrated in FIG. 11, the non-depleted roll 49*b* may have been used from access via the opening 48 while in the secondary dispensing position after the roll 49*a* had already reached its depleted (stub) state.

Figure 12:
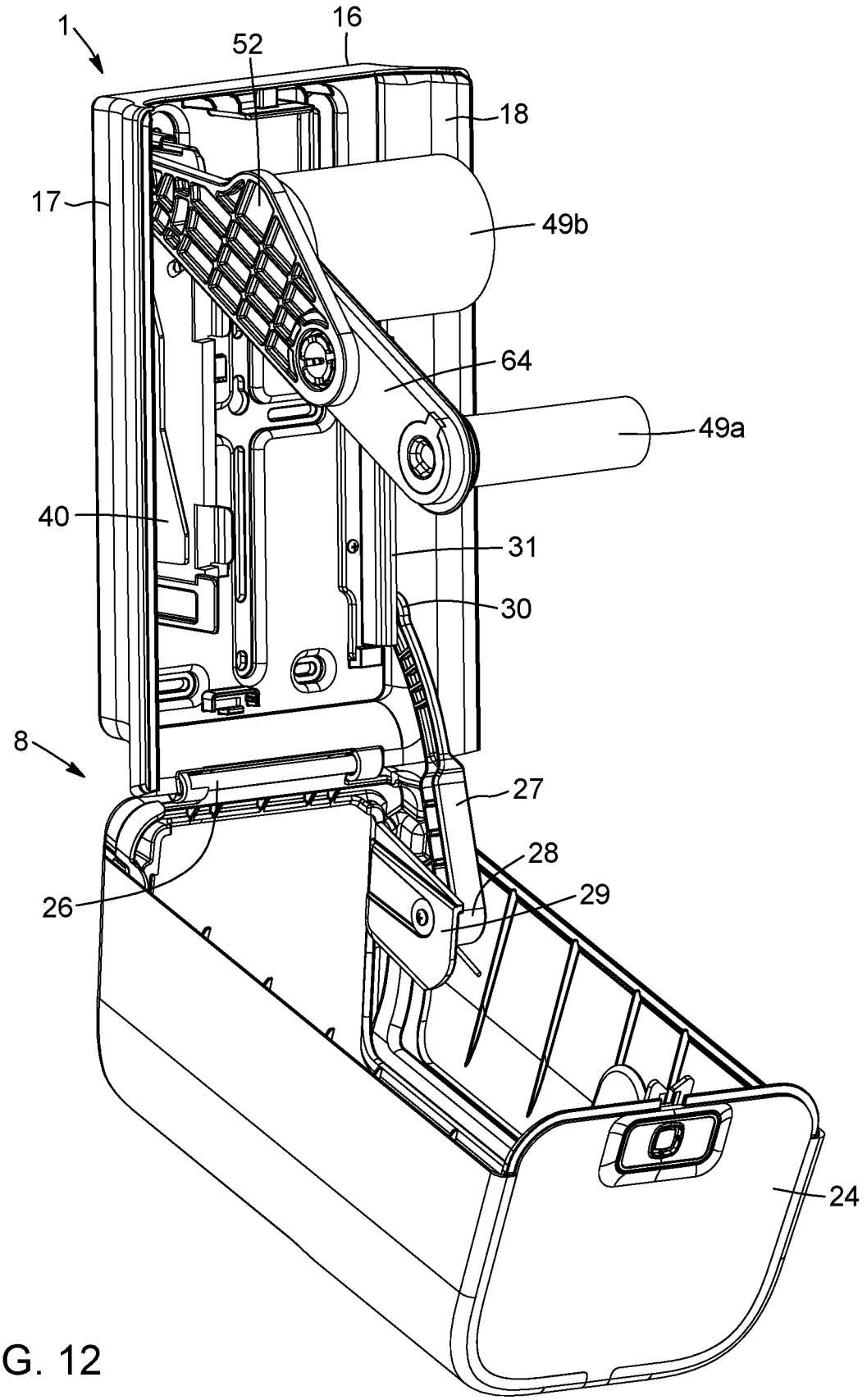
FIG. 12 illustrates a perspective view of the web material dispenser according to the example embodiment, the linkage arm being in a roll changing position.

Referring now to FIG. 12, therein illustrated is a perspective view of the web material dispenser 1 according to the example embodiment in the empty state and the linkage arm 52 in a roll changing position. It will be understood that FIG. 12 illustrates a second intermediate state of the method for using the web material dispenser 1 to switch the positions of the rolls in the web dispenser 1 and to change the roll of web material supported on one of the mandrels 80, 88. To reach this second intermediate state from the first intermediate state illustrated in FIG. 11, an operator operates the linkage arm 52 to pivot it about its pivot axis from its dispensing position to its roll changing position. This operation of pivoting the linkage arm 52 can be a one-handed operation. It will be appreciated that the roll support arm 64 has not been actuated by an operator and has the same position in relation to the linkage arm 52, even if the roll support arm 64 has been moved with the movement of the linkage arm 52.

Figure 13:
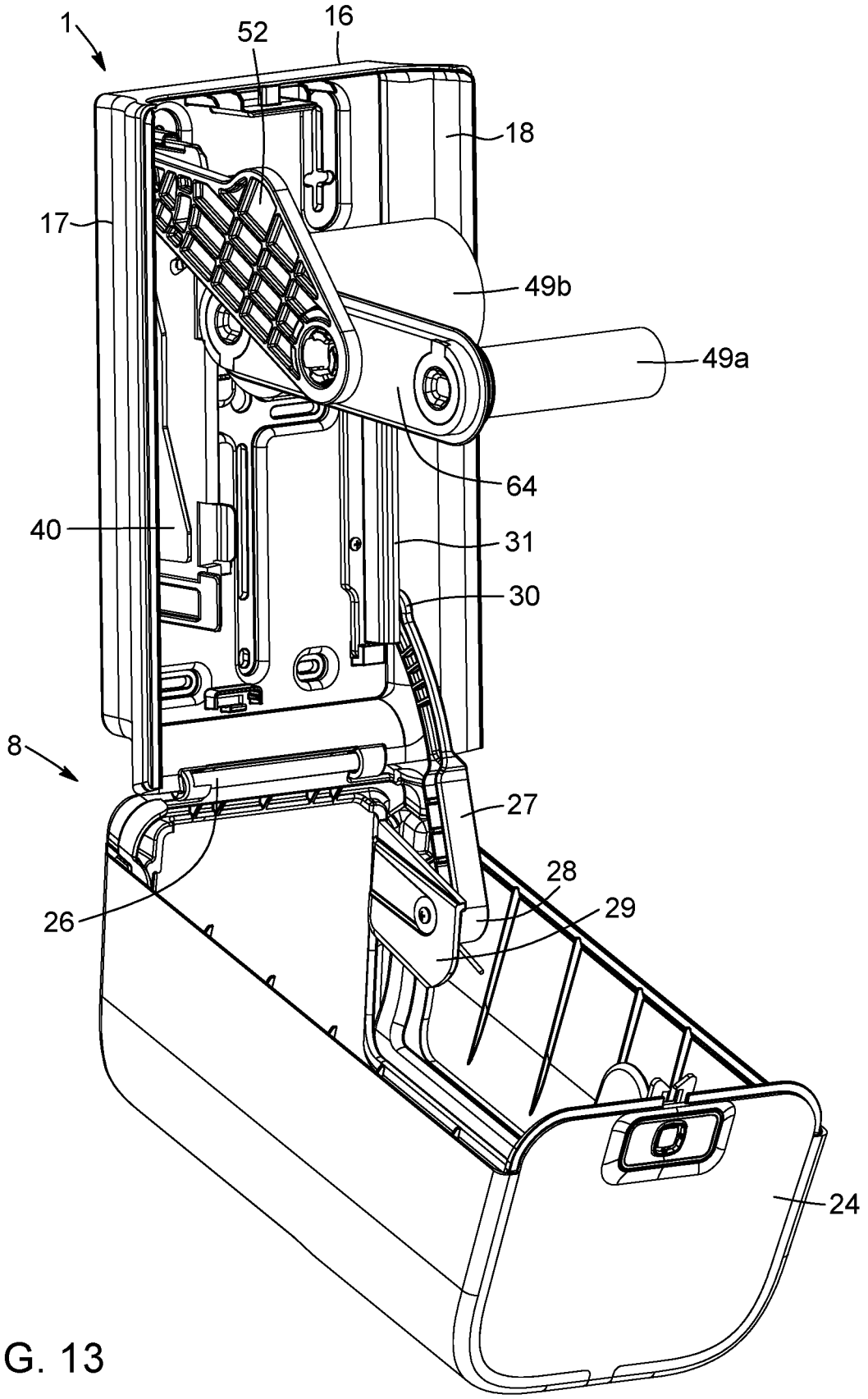
FIG. 13 illustrates a perspective view of the web material dispenser according to the example embodiment, with the roll support arm in a roll support roll changing position.

Referring now to FIG. 13, therein illustrated is a perspective view of the web material dispenser 1 according to the example embodiment in the empty state and with the roll support arm 64 in a roll support roll changing position. The linkage arm 52 is also in a linkage arm roll changing position. As described elsewhere herein, in this position of the linkage arm 52 and the roll support arm 64, one of the mandrels 80 (supporting partially used roll 49*b*), 88 (supporting empty roll 49*a*) is positioned forwardly of the other of the mandrels 88, 80 relative to the back-wall member 16. Furthermore, the mandrels 80, 88 can be at substantially the same height. The position of the forwardly positioned mandrel facilitates changing the roll supported by that mandrel. However, it will be understood that the roll does not necessarily have to be changed with the mandrel in this position, and changing of the roll can also be carried out with the roll support arm 64 and linkage arm 52 in their respective dispensing positions, as illustrated in the Figures herein.

It will be understood that FIG. 13 illustrates a third intermediate state of the method for using the web material dispenser 1 to switch the positions of the rolls in the web dispenser 1 and to change the roll of web material supported on one of the mandrels 80, 88. To reach this third intermediate state from the second intermediate state illustrated in FIG. 12, an operator operates the roll support arm 64 to pivot it about its pivot axis from its dispensing position to its roll changing position. This operation of pivoting the roll support arm can be a one-handed operation. As described elsewhere, and according to an embodiment, retaining mechanism of the roll support assembly 32 can maintain the roll support arm 64 in this roll changing position until further operation.

Figure 14:
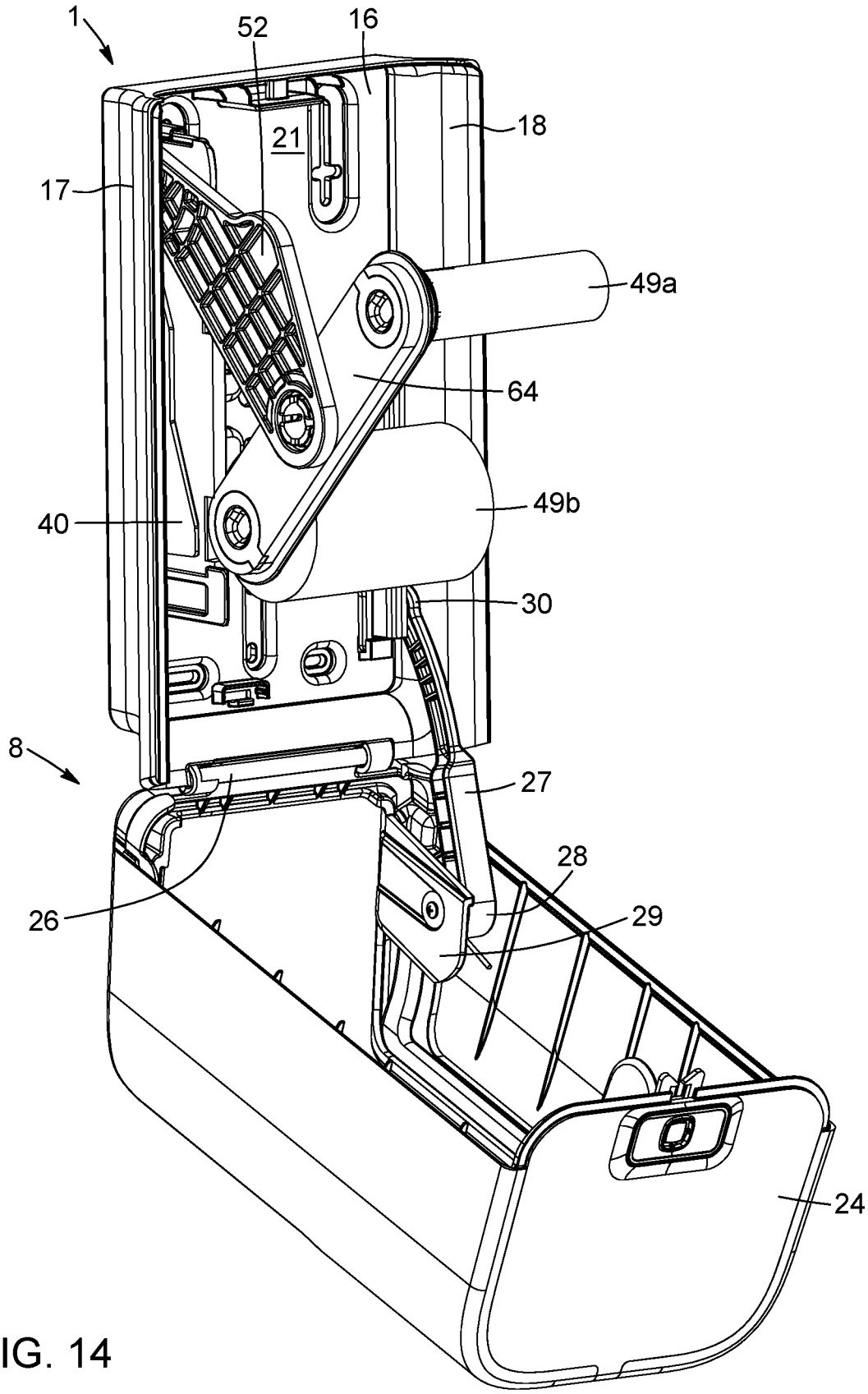
FIG. 14 illustrates a perspective view of the web material dispenser according to the example embodiment, with the roll support arm in an intermediate position.

Referring now to FIG. 14, therein illustrated is a perspective view of the web material dispenser 1 according to the example embodiment in the empty state with the roll support arm 64 is an intermediate position. This corresponds to a fourth intermediate state of the method for using the web material dispenser 1 to switch the positions of the rolls in the web dispenser 1 and to change the roll of web material supported on one of the mandrels 80, 88. To reach this intermediate state from the third intermediate state illustrated in FIG. 13, the operator continues pivoting the roll support arm 64 about the pivot axis 72. Where a retaining mechanism is provided within the linkage assembly 32, a sufficient torque is applied to disengage the retaining mechanism. It will be appreciated that from this continued pivoting, the mandrel 88 that was previously in the lower position (primary dispensing position) has now been pivoted to be higher than the other mandrel 80.

Figure 15:
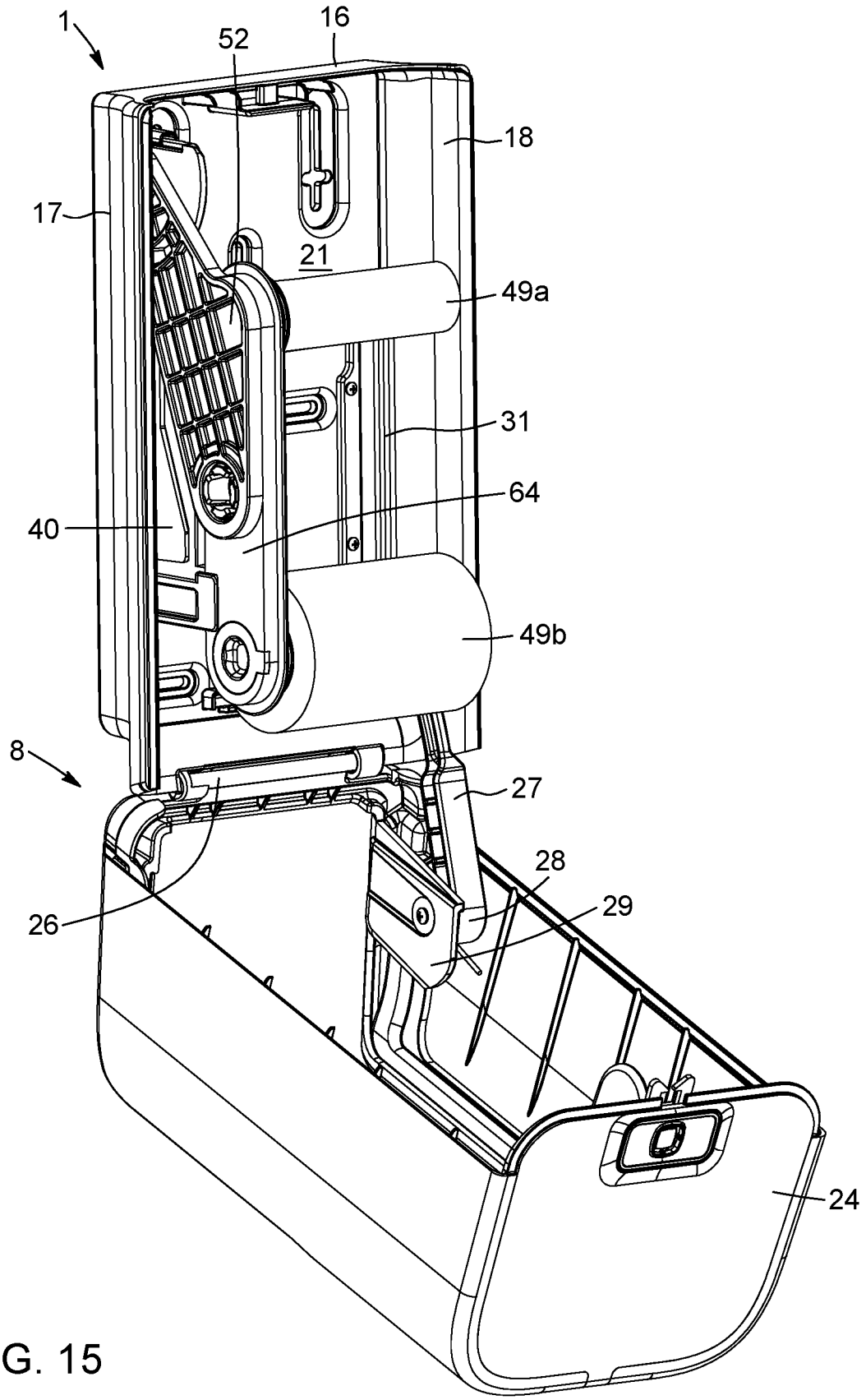
FIG. 15 illustrates a perspective view of the web material dispenser according to the example embodiment, with the position of the depleted roll being switched, and with the linkage arm having returned to its dispensing position and with the roll support arm having entered a second roll support dispensing position.

Referring now to FIG. 15, therein illustrated is a perspective view of the web material dispenser 1 according to the example embodiment in the empty state and with the linkage arm 52 having returned to its dispensing position and the roll support arm 64 having entered a second roll support dispensing position. It will be appreciated that the first mandrel 80 holding the partially used roll 49*b*, and which was previously located in the secondary dispensing position (FIG. 11), has now been moved to the primary dispensing position. Conversely, the second mandrel 88 holding the empty roll 49*a*, and which was previously located in the primary dispensing position (FIG. 11), has now been moved to the secondary dispensing position.

It will be understood that FIG. 15 illustrates a fifth intermediate state of the method for using the web material dispenser 1 to change the roll of web material supported on one of the mandrels 80, 88. To reach this fifth intermediate state from the fourth intermediate state illustrated in FIG. 14, an operator operates the roll support arm 64 to pivot it about the pivot axis 72 to its second dispensing position and operates the linkage arm 52 to pivot it back to the linkage arm dispensing position. This operation of pivoting the roll support arm 64 and the linkage arm 52 can be a one-handed operation. Pivoting of the linkage arm 52 and pivoting of the roll support arm 64 can be carried out at substantially the same time in a smooth motion.

Referring now to FIG. 16, therein illustrated is a perspective view of the web material dispenser 1 according to the example embodiment having a full roll. It will be appreciated that after positioning the linkage arm 52 back to its linkage arm dispensing position and the roll support arm 64 to its second dispensing position, the empty roll of web material supported on the mandrel 88 in the secondary dispensing position has been replaced by a new full roll of web material 49*a'*.

Referring now to FIG. 17, therein illustrated is a perspective view of the web material dispenser 1 according to the example embodiment being ready for use. It will be appreciated that within the method for using the web material dispenser 1, the cover member 24 has been placed back in its closed position. The partially used roll 49*b* supported on the first mandrel 80 is now in the primary dispensing position and is accessible through the opening 48. The newly placed full roll of web material 49*a*' supported on the second mandrel 88 is now in the secondary dispensing position, but remains partially accessible through the opening 48. The web material dispenser 1 is now ready to dispense material.

Figure 18A:
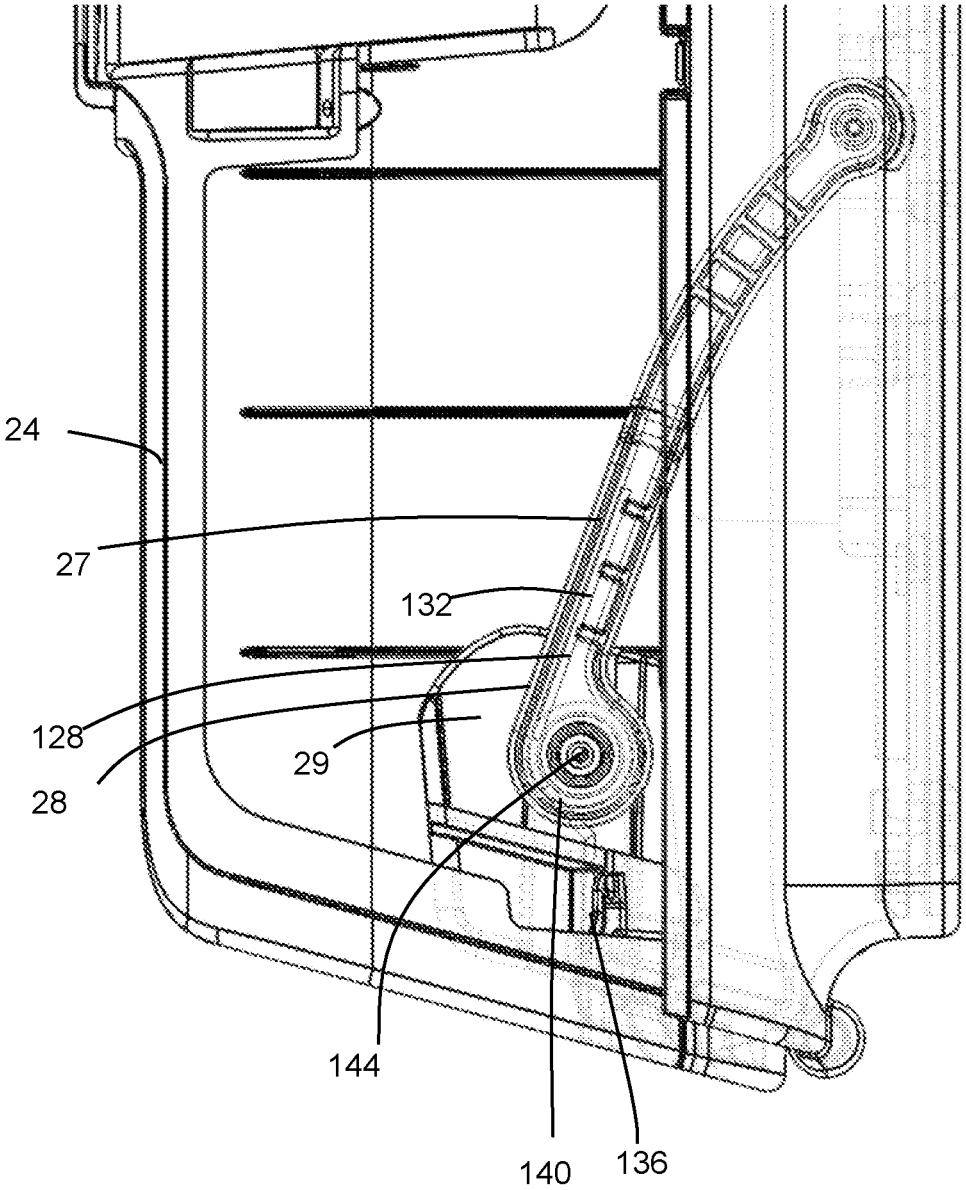
FIG. 18A illustrates a close-up partially transparent view of a stopping arm and an inner member of a cover member in the closed position according to one example embodiment.
Figure 18B:
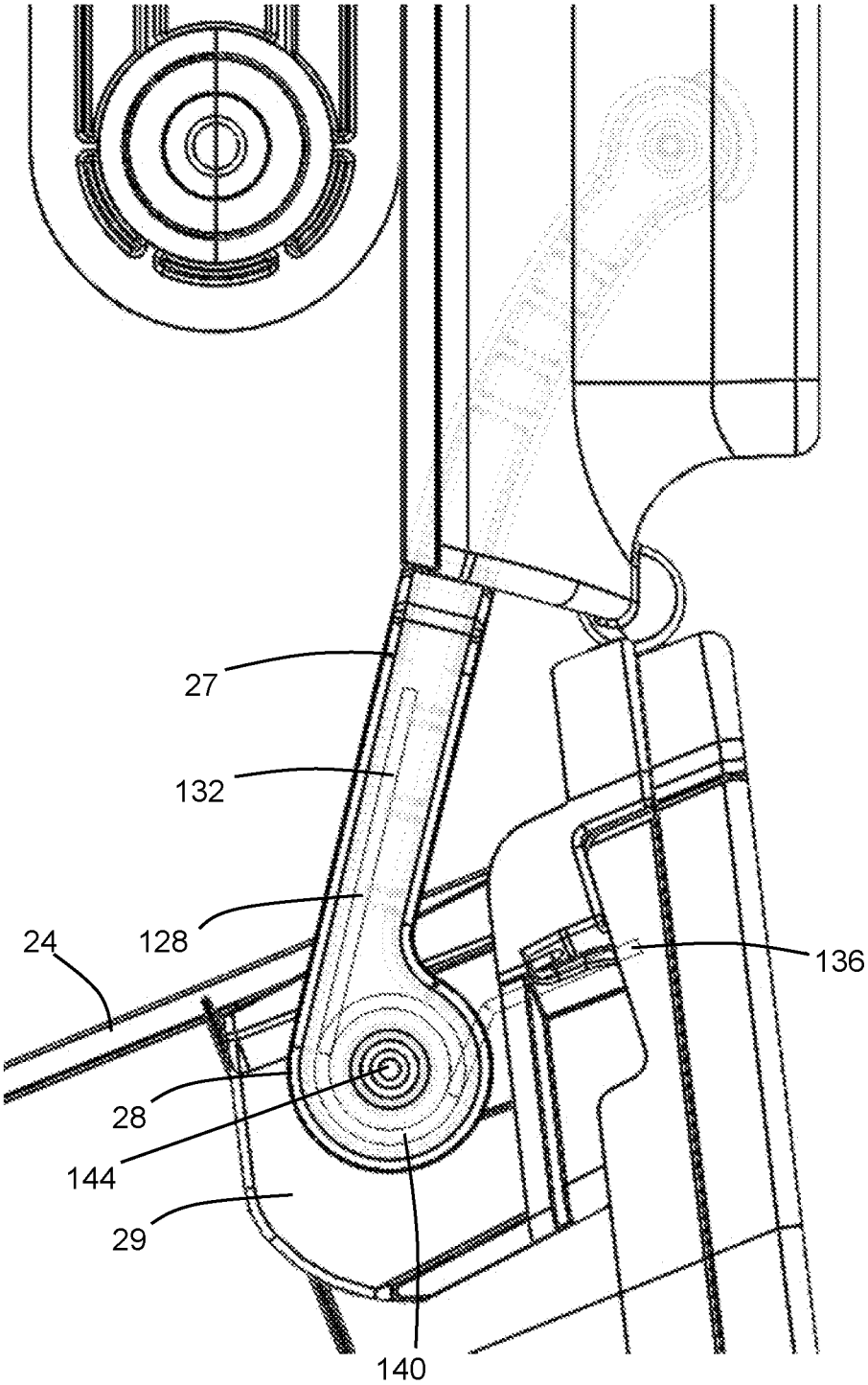
FIG. 18B illustrates a close-up partially transparent view of the stopping arm and the inner member of the cover member in the open position according to one example embodiment.

Referring now to FIGS. 18A and 18B, therein illustrated are close-up, partially transparent views of the engagement of the lower end 28 of the stopping arm 27 with the inner member 29 in the closed position and open position, respectively, of the cover member 24. A spring member 128, for example a compression spring, has a first leg 132 that engages and extends along a portion of the length of the stopping arm 27. The spring member 128 also has a second leg 136 that engages and extends along a portion of the inner member 29. A central portion 140 of the spring member 128 extends about a pivotal attachment point 144 of the stopping arm 27 to the inner member 29. As the cover member 24 is moved from its closed position to its open position, the inner member 29 is pivoted with movement of the cover member 24, which further causes flexing of the spring member 128. This flexing causes the spring member 128 to enter a stretched state and apply a biasing force on the cover member 24 in the upward direction. This upward force counteracts the force of gravity on the cover member 24, thereby providing the damping force that slows the movement of the cover member 24 as it approaches a fully opened position.

Advantageously, various embodiments described herein provides a web material dispenser that is easy to operate to change one or both of the rolls of web material supported on the mandrels of the web material dispenser. More particularly, an operator can swap the positions of the rolls of web material supported on the mandrels from the primary dispensing position to the secondary dispensing position, and vice versa, using a one-handed operation. Similarly, an operator can change the roll of web material supported on any one of the mandrels of the web material dispenser using a one-handed operation.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative and non-limiting and it will be understood by persons skilled in the art that other variants and modifications may be made without departing from the scope of the invention as defined in the claims appended hereto.

What is claimed is:

1. A web material dispenser comprising:

a housing for housing first and a second rolls of web material, the housing comprising a back-wall member and an opening for dispensing the web material;

a roll support assembly mounted to the housing and configurable in at least one roll changing position and at least one dispensing position, the roll support assembly comprising:

a roll support arm having first and second ends, at least one of the first and second ends of the roll support arm being spaced-apart from the back-wall member of the housing in the at least one roll changing position and the first and second ends being closer to the back-wall member of the housing in the at least one dispensing position, the at least one dispensing position comprises at least a first dispensing position wherein the first end of the support arm is located above the second end of the support arm and a second dispensing position wherein the second end of the support arm is located above the first end of the support arm;

a first mandrel provided at the first end of the roll support arm for supporting a first roll of web material; and a second mandrel provided at the second end of the roll support arm for supporting a second roll of web material.

2. The web material dispenser of claim 1, wherein the roll support assembly further comprises a linkage arm is pivotally mounted to the housing at a first attachment location and having a second attachment location, spaced-apart from the first attachment location, the linkage arm being configurable in the at least one roll changing position wherein the second attachment location is spaced-apart from the back-wall member of the housing and the at least one dispensing position wherein the second attachment location is closer to the back-wall member of the housing.

3. The web material dispenser of claim 2, wherein the roll support arm is pivotally mounted to the linkage arm at the second attachment location and wherein the first and the second ends of the roll support arm are located on opposed sides of a connection to the second attachment location.

4. The web material dispenser of claim 2, wherein the linkage arm extends forwardly from the back-wall member and the back-wall member defines a backing plane;

wherein, in the at least one dispensing position, the linkage arm is configured in a linkage arm dispensing position and forms a first angle with the backing plane; and wherein in the at least one roll changing position, the linkage arm forms a second angle with the backing plane, the second angle being greater than the first angle.

5. The web material dispenser of claim 4, wherein the second attachment location of the linkage arm is a fixed location on the linkage arm;

wherein the first attachment location of the linkage arm defines a pivot axis of the linkage arm, representing a first pivot axis, parallel to the backing plane, the linkage arm being rotatable about the first pivot axis relative to the housing; and wherein the second attachment location of the linkage arm defines a pivot axis of the roll support arm, representing a second pivot axis, the second pivot axis being parallel to the first pivot axis, the roll support arm being rotatable about the second pivot axis relative to the linkage arm.

6. The web material dispenser of claim 5, wherein when the dispenser is in use, the pivot axis of the linkage arm is located above the pivot axis of the roll support arm.

7. The web material dispenser of claim 5, wherein the pivot axis of the roll support arm is located between the first and second ends of the roll support arm.

8. The web material dispenser of claim 4, wherein:

the housing comprises the back-wall member and a cover member movable between a closed position and an open position with respect to the back-wall member;

in the closed position of the cover member, the first and second mandrels are partially enclosed within the housing; and in the open position of the cover member, the linkage arm and the roll support arm can both be pivoted to replace the first or second rolls of web material when depleted and/or to switch positions of the first and second rolls of web material relative to the opening.

9. The web material dispenser of claim 8, wherein:

in the closed position and upon the first roll of web material being supported on the first mandrel and the second roll of web material being supported on the second mandrel, at least a portion of each of the first roll of web material and the second roll of web material is accessible through the opening of the housing.

10. The web material dispenser of claim 4, further comprising:

an interfacing member extending forwardly from the back-wall member, the linkage arm being pivotally attached to the interface member;

wherein the interfacing member is coupled to one of a left side and a right side of the housing.

11. The web material dispenser of claim 10, wherein the interfacing member comprises an arcuate guiding mechanism operable to guide pivotal movement of the linkage arm relative to the housing, the arcuate guiding mechanism of the interfacing member providing an arc-shaped path; and wherein the linkage arm comprises a follower element operatively engaging the arcuate guiding mechanism along the arc-shaped path.

12. The web material dispenser of claim 2, wherein the roll support arm is operable to pivot about the second attachment location of the linkage arm between the at least one roll changing position and the at least one dispensing position;

wherein in the at least one dispensing position, one of the mandrels is located above the other of the mandrels; and wherein in the at least one changing position, one of the mandrels is located forwardly of the other of the mandrels.

13. The web material dispenser of claim 12, wherein:

In the at least one dispensing position, the roll support arm extends substantially parallel to the back-wall member; and in the at least one roll changing position, the roll support arm extends substantially perpendicular to the back-wall member.

14. The web material dispenser of claim 12, wherein the first and second mandrels are maintained at a fixed position relative to one another and relative to the housing when the roll support arm is in the at least one dispensing position for dispensing material.

15. The web material dispenser of claim 12, wherein the roll support assembly further comprises a retaining mechanism operable to selectively retain the roll support arm in the at least one dispensing position or in the at least one roll changing position.

16. The web material dispenser of claim 1, wherein:

the first and second mandrels extend from the first end and from the second end of the roll support arm, respectively; and the first and second mandrels comprising first and second extending ends, respectively, said first and second extending ends being open.

* * * * *